US010595638B2

(12) United States Patent
Liu

(10) Patent No.: US 10,595,638 B2
(45) Date of Patent: Mar. 24, 2020

(54) CHAIR PROVIDING LIFTING FORCE TO THE USER

(71) Applicant: Henry C. Liu, Irvine, CA (US)

(72) Inventor: Henry C. Liu, Irvine, CA (US)

( * ) Notice: Subject to any disclaimer, the term of this patent is extended or adjusted under 35 U.S.C. 154(b) by 0 days.

(21) Appl. No.: 15/377,543

(22) Filed: Dec. 13, 2016

(65) Prior Publication Data

US 2017/0196371 A1 Jul. 13, 2017

Related U.S. Application Data

(60) Provisional application No. 62/276,949, filed on Jan. 10, 2016.

(51) Int. Cl.

| | |
|---|---|
| ***A47C 7/40*** | (2006.01) |
| ***A47C 7/54*** | (2006.01) |
| ***A47C 9/00*** | (2006.01) |
| ***A61G 5/14*** | (2006.01) |

(52) U.S. Cl.

CPC ..... *A47C 7/402* (2013.01); *A47C 7/54* (2013.01); *A47C 9/002* (2013.01); *A61G 5/14* (2013.01)

(58) Field of Classification Search

CPC ..... A47C 7/402; A47C 7/54; A47C 9/002; A61G 5/14

See application file for complete search history.

(56) References Cited

U.S. PATENT DOCUMENTS

| | | | | |
|---|---|---|---|---|
| 8,919,797 | B2 * | 12/2014 | Lowenthal | A61G 5/1043 280/250.1 |
| 9,039,087 | B2 * | 5/2015 | Lee | A47C 7/54 297/353 |
| 10,080,438 | B2 * | 9/2018 | Paul | A61G 15/02 |
| 2008/0111338 | A1 * | 5/2008 | Ilan | A61G 5/023 280/250.1 |
| 2013/0026737 | A1 * | 1/2013 | Pizzi Spadoni | A61G 5/061 280/647 |
| 2014/0284988 | A1 * | 9/2014 | Gefen | A47C 4/52 297/452.41 |
| 2017/0196371 | A1 * | 7/2017 | Liu | A47C 7/54 |
| 2019/0133325 | A1 * | 5/2019 | Liu | A47C 7/54 |

* cited by examiner

*Primary Examiner* — Philip F Gabler

(74) *Attorney, Agent, or Firm* — Charles C. H. Wu; Wu & Reddy, A Prof. Corp.

(57) ABSTRACT

A back lifting chair designed for treating and preventing back problems by reducing pressure on a user's spinal disc. The chair provides an up-lifting motion on the user's torso, reducing the weight and pressure asserted on the lumbar disc, and preventing any further damage to it. The chair can be modified from an existing chair. In one configuration, a torso lifting harness which can lift the user's upper torso is connected to the backrest of the chair. The back rest of the chair provides an upward and downward movement, hence partially or completely lifting the user from the seat, effectively reducing the pressure on the user's spine and back. The upward motion can be initialized by the user, or alternatively, it can be automatically activated by the weight sensor installed on the seat area which detects the prolonged period of sitting.

54 Claims, 18 Drawing Sheets

CHAIR PROVIDING LIFTING FORCE TO THE USER

This application claims the benefit of U.S. Provisional Application No. 62/276,949 filed Jan. 10, 2016.

FIELD OF INVENTION

This invention relates to devices and in particular chairs which aim to prevent and or repair human back and spine problems.

BACKGROUND OF INVENTION

Many people have experienced back pain sometime in their lives. The causes of back pain are numerous. Some back pain is due to accidents, muscle strains, and sports injuries. But nowadays the most common cause is bad sitting habit. Sitting too long at a bad posture, for example, often happens with a computer operator or taxi driver in their daily activity. With correct posture such as standing or lying down, the spine is straight, and the internal pressure is equalized on all parts of the spine and muscles. On the other hand, with sitting with bad posture for several hours, the spine's internal pressure can rise up 5 times higher than that of lying down position. Such persisting pressure can lead to stiff muscles, limited circulation, and long term spine and bone damage.

A normal chair consists of three major components: The leg portion extended from the ground to a suitable height will provide support for the whole structure; The seat portion provides a comfortable flat surface to uphold the human body; The backrest portion provides another flat surface for the human torso to lean on. This basic structure has remained the same from ancient times. Alternatively, a chair without backrest is considered a stool, and a chair with an extra arm rest is called an armchair. Unfortunately, this basic structure gives little relief to back problems. As studies have shown, at an average sitting posture, the pressure on the lower back is 40 to 90 percent higher than that of standing posture, and several times higher than that of lying down posture. In some special cases, such as the person leaning notably forward to stare at the computer screen, the weight of his upper torso will be un-evenly distributed across his spine. Such awful posture increases the tension on his muscle, nerve and bone tissue, and speeds up the aging process. Over several years of exposure to excess pressure, a mid-aged person often experiences back pain, simply by sitting on the average chair for too long. Besides back problems, long sitting often causes other heath related issues, such as edema of lower legs, varicose veins, hemorrhoids, cold feet, and many other venous problems that can be attributed to sitting habits to a certain degree.

The most common type of advice that doctors give to patients with back problems is to refrain from the prolonged sitting posture in daily life. For example, some treatments include climbing a few stairs after half hour of desk work or walking around the building several times each day. All these will help to exercise the muscle around the back, increase blood flow and prevent fatigue, edema and various venous/muscle problems. Also, during walking, the pressure from the upper torso is evenly distributed on the spinal disc, as opposed to concentrated on a single spot during certain sitting positions. Hence the reduced pressure is less likely to cause damage to the disc. However, as an occupational hazard, several careers demand sitting for long period in work. For example, taxi drivers, truck drivers, or air traffic controllers all needs to sit for several hours in their daily work. In many other cases, the person working at a desk tends to forget advice from the doctors, and stay for hours before getting out of the chair. In U.S. Pat. No. 5,113,176, the author presents a lumbar roll device that can alert the user for poor posture or for sitting too long, and can remind the user for the need to exercise. Besides self performed exercises, a few other inventions proposed chairs that assist the user in exercising their lower back. These can typically be classified as 'exercising chairs'. In U.S. Pat. No. 5,110,121, a chair that can exercise muscle on lower back based on spring resistance back pad and stationary lumbar support pad is introduced. In U.S. Pat. No. 7,377,889 B2, a general use chair that can provide a dynamic thrust motion to exercise the user's spine is proposed. U.S. Pat. Nos. 5,730,688 and 6,312,366, described abdominal-lumbar exercise devices that use flexible upright resilient members so that the user can exercise by pivoting against the resilience. U.S. Pat. No. 6,655,731 presents an orthopedic chair that includes a frame for supporting a contoured chair seat and back that rotate on a horizontal axis. This chair holds the person in a beneficial position for back support.

All the inventions mentioned above aim to exercise the muscle of the lower back, or alternatively, remind the user to quit sitting and engage in more exercise. However, if the user has already suffered a certain type of back spinal problem such as herniated disc, bulging disc, or is confined to the chair due to occupational requirements, the existing inventions provide little to help the situation. In this invention, we propose a new chair structure that can partially or completely lift the torso of the user from the chair, and hence reducing the weight asserted on the lumbar section of the spine. In this manner, we provide the relief on the spinal disc, and hence preventing any damage on it. The relief of pressure happens whenever the user sits in the chair, and does not require the user to engage in any voluntary exercise activity.

SUMMARY OF THE INVENTION

This invention provides a new design of the general chair. This chair has the capability to detect the weight on the seat portion of the chair. Based on the sensor input (high pressure for certain period of time), the chair will lift up the upper torso of the user, hence reducing the pressure asserted on his spine. The reduction of the pressure helps to prevent and alleviate the damage inflicted from long term sitting. This chair carries the components of a traditional chair. In addition, there is a series of lifting harnesses attached to the back support member of the chair. These harnesses attach the user's upper body to the back support. The back support member of the chair is designed to be able to perform an upward and downward movement, hence lifting the upper body up and down. The lifting action can be activated manually, or on a pre-set timer. Alternatively, a weight sensor installed on the seat member of the chair can provide a real time analysis of the posture of the user. Based on the weight level and duration, the back support can be programmed to lift up automatically or periodically, hence reducing the pressure on the sitter's spine.

In this disclosure, the concept of chair includes any sitting device that can be used in daily life. This chair can be made of wood, metal, plastic or any other material or combination of materials. The various components of the chair can be adjusted to a number of different configurations within the scope of this invention. For instance, the seat and leg portions of the chair can be adaptable to various size, shape, or operation, including standard four leg chairs, office chairs with one cylinder base with wheels on the bottom, or one piece chair in automobiles. The described chair can be used in many locations or scenarios, such as family rooms, dinning rooms, offices, buses, airplanes, or fitness centers.

The primary objective of this invention is to provide means to lift the upper torso of the sitter, thus the pressure asserted on his lumbar spine is reduced. The reduced pressure will encourage blood circulation, relax the muscle and nerves, and prevent damage to the spinal disc, joint, and surrounding tissues. The sitter can still enjoy free movement and operation as in the conventional chair, and his health and comfort are improved.

It is also an important objective of the present invention to provide a chair that utilizes lifting motion to reduce and prevent problems associated with a long duration of sitting, such as fatigue, pain, numbness, and other discomforts.

It is also an important objective of this invention to provide a chair that has a harness member that is attached to the back support member of the chair. This harness is able to lift the user by pushing his axilae upward.

It is also an important objective of this invention to provide a chair that has a harness member that is attached to the back support member of the chair. This harness is able to fasten the upper torso of the sitter to the back support of the chair.

It is also an important objective of this invention to provide a chair that has a harness member that resembles two holding hands. And this member will be able to hold the user's torso and haul it upward.

It is also an important objective of this invention to provide a chair that has a back support member that can provide a vertical upward and downward motion that can lift and release the sitter's upper torso through the previously mentioned attaching harness.

It is also an important objective of this invention to provide a chair that has a variety of sensors installed on the seat member of the chair that can detect the posture and weight distribution of the user's sitting time. These sensors will help activate the lifting operation of the back support unit.

The above and other objectives of the present invention will be explained in greater detail in attached figures and descriptions which follows. As set forth herein, the present invention resides in the novel features of form, construction, mode of operation, and combination of these processes.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

The description and figures are merely demonstration of the preferred embodiments and several examples of configuring the present invention. It should be known that variations on specific components, materials, shapes, configurations, and usage can be made without changing the scope and function of present invention.

Figure 1:
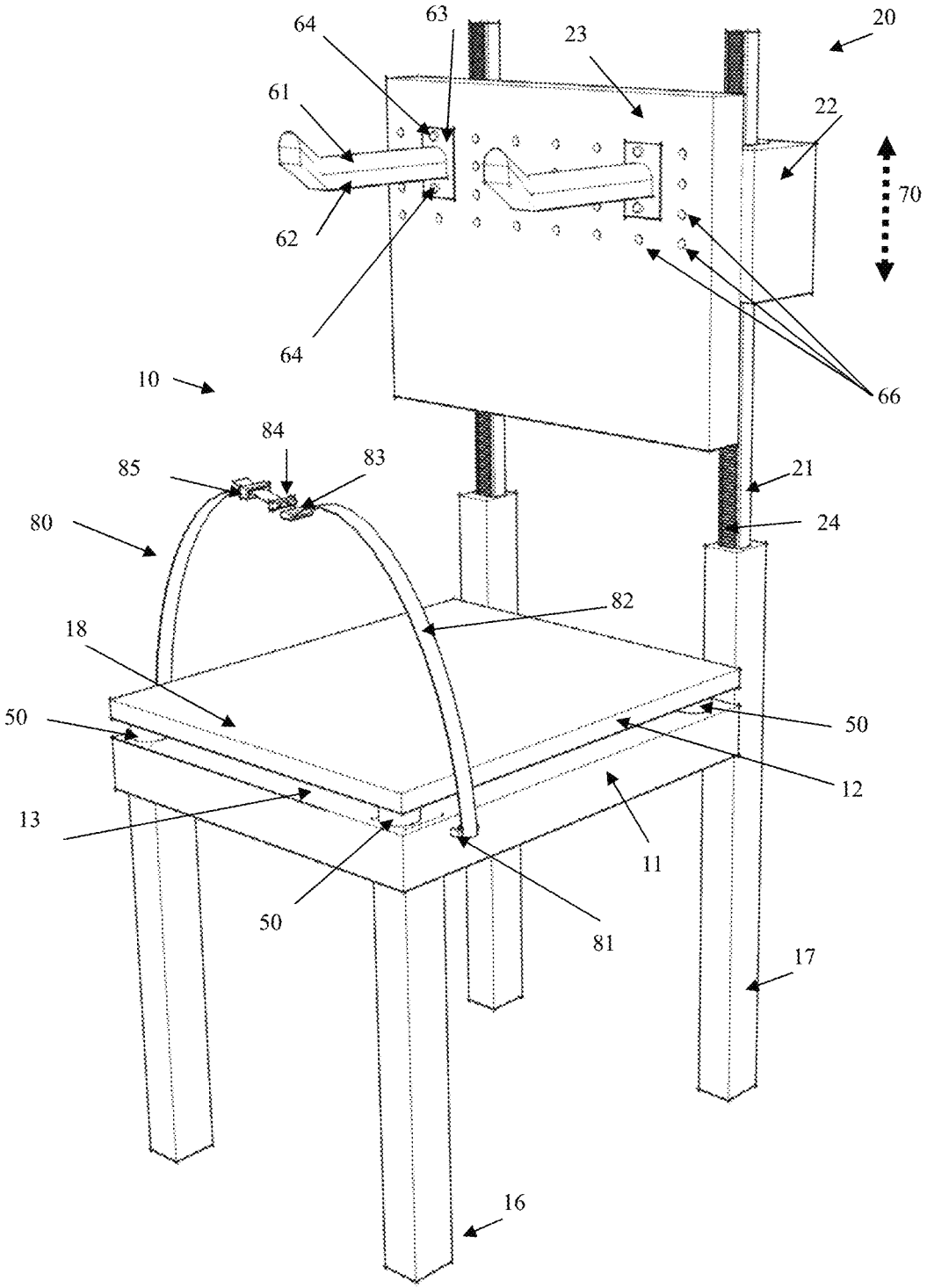
FIG. 1 is a perspective view of Embodiment A of the back lifting chair in the form of conventional chair.

The chair of the present invention is identified as 10 in the figures. It has several different implementations. The first implementation is specified as Embodiment A and it is depicted in FIG. 1 through FIG. 7. In this embodiment, the chair comprises two front legs 16 and two rear legs 17. These legs have a simple function: to support all the other structures and the sitter above them. As shown in FIG. 1, directly above the leg assembly is a horizontal flat board member 11, which has a upper surface 13 and opposing surface 14 facing down. On the up facing surface 13, there are 4 pressure/weight sensors 50 placed at each one of the four corners. These sensors can monitor the pressure passed down from the sitter at each position of the chair. The weight information will later be used to adjust the uplifting power, either automatically or manually. Once the sitter has been lifted partially or fully, the weight asserted on these sensors 50 will be reduced. These sensors 50 will detect the reduction on the pressure, and this information will help the controller unit to increase or reduce the lifting power until the optimal result is accomplished. Directly above the four sensors 50 is the seat board 12. This seat 12 is configured to directly sustain the sitter's weight and give the sitter the proper support. The seat board has both up facing surface 18 and downward facing surface 19. It is sometimes preferable to put soft material such as foam, fabric, or leathers at upper surface 18 to make sitter comfortable. The structure 11 will support the weight sensor 50, the seat board 12, and the sitter further above.

It should be pointed out that even without the weight sensor 50 and extra seat board 12, the flat board 11 is still capable to support the sitter and the present invention can still perform the lifting functionality and provide most of the health benefit. However, it is recommended that the weight sensor 50 and extra seat board 12 being adopted for better performance. This is because without this weight sensor, the uplifting power can not be accurately monitored. The force to lift the sitter has to be either manually configured by the user based on his feeling, or set to a fixed value. Neither of these cases will provide optimal health advantage. With the pressure sensors 50, the chair and user can constantly monitor the duration and magnitude of the pressure that has been asserted on the spine of the sitter, hence making corresponding adjustment. In one exemplary implementation, when the user has just sat on the chair, no up-lifting force will be applied, and the weight sensor will detect and calculate the original pressure asserted on the user's spine. After a few minutes, the uplifting mechanism will be activated and lifting the upper torso of the user. As time goes by, the chair will apply more and more lifting force on the user, and hence give the lumbar and spine more and more relief. During the whole time, the weight sensor will be able to detect the pressure change and make sure the correct lifting force is being applied. More importantly, when the sitter changes his sitting pose, and causes the pressure level variation on his spine. The weight sensor will be able to detect this activity and send this information to the control unit in the lifting assembly. The lifting assembly will be able to make adjustment on the lifting force to make sure the pressure level on the spine remains at a constant level for maximum health benefit or user comfort. Overall, the combination of pressure sensor and lifting mechanism will render a closed-loop control system with a real-time feedback link. This design allows much better control and optimization of the system operation, and it can also give certain safety guarantee to prevent too much lifting force.

In practice, chair 10 can be adapted to any type of general use chair, such as power seat in automobiles with no legs but a support base assembly, or a typical office chair with a single supporting base. In this configuration, the same design on weigh sensors 50 and seat board 12 can be adopted, and it is still preferable to have weight sensor 50 deployed between support board 11 and seat board 12, hence it can monitor the pressure change continuously.

Figure 2:
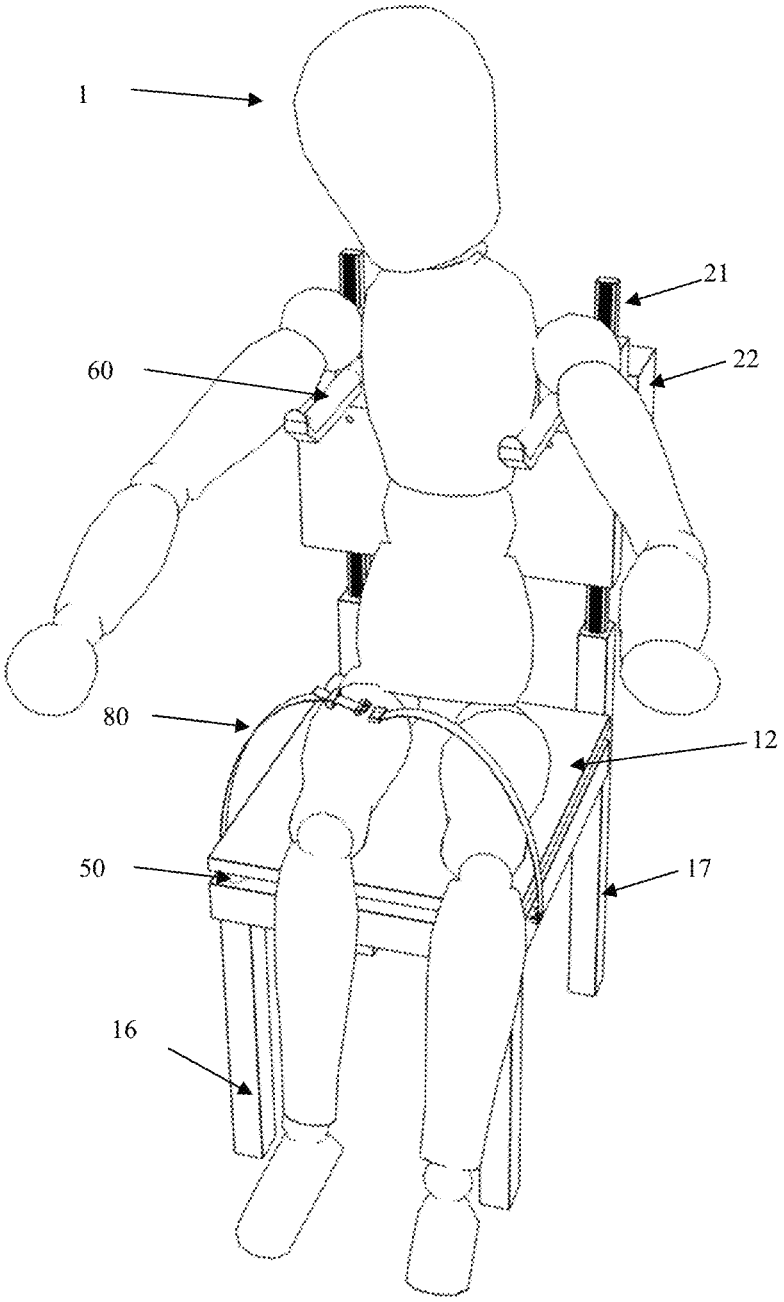
FIG. 2 is a front perspective view of Embodiment A of the chair in FIG. 1 with the user sitting on it.

In FIG. 2, we have illustrated a design with 4 pressure sensors 50. However, based on the various chair structure and design, it is obvious that more (or less) sensors can be adopted here. With more (or less) pressure reading, a well designed control program will be able to accurately detect and calculate the actual sitting posture and pressure distribution on the user's spine. For example, if the user is leaning to the left or right of the chair, the array of weight sensors will easily detect his weight shift. Correspondingly, the chair can make proper reaction on its operation. It can adjust the lifting force and duration, or adjust the holding force on user's upper torso with the holding assembly 30 or 60 (which will be introduced later). Alternatively, many modern chairs have adjustable tilt control on the supporting seat board 12, vertical member 17 and 21, or the back support board 23 which allows fine tuning of the tilt angle or the change of the supporting structure (such as lumbar bulging design on the power seat on many modern automobiles). The detailed weight distribution information can be applied to adjust seat board 12, vertical member 17 or 21, or back support board 23 to a different tilt angle, a different shape, or other different configuration, for one of the following reasons: reduce the pressure on the user spine; correct his wrong posture (such as tilting backward if the user is leaning forward too much); give user maximum comfort; or allow the user to perform other specific tasks. Typically, with more weight sensors, the chair can be better adjusted in its lifting operation.

The weight sensor reading can be distributed to other parts of the chair or the user either through wire line communications such as I2C or UART links, or through wireless links such as WIFI or Bluetooth connections. In addition, the pressure reading can be exhibited on a display panel on the chair, transferred to the user's computer, phone, or other electronic device through wireline/wireless connection, or as an audio/vibration signal to alert un-healthy pressure levels for a certain duration of time. The various kinds of implementations on pressure information all require the implementation of the weight sensor 50 being included as an important part of the present invention.

Directly above leg assembly 17 is the lifting assembly 20. The vertical member 21 extends directly above leg assembly 17. Alternatively, vertical member 21 may also be attached to the side of the bottom of the flat board member 11, or built in place of the leg 17 and extended directly to the ground. Since the lift assembly 20 may sustain a big portion of the sitter's weight as well as its own weight, it is recommended that the vertical member 21 be assembled with solid durable materials such as steel and possess adequate thickness and size. The vertical member 21 can be built into a geared rack structure 24 with toothed bars or rods on its forward facing surface. This rack 24 can be paired with a Pinion structure inside the motor assembly 22. The motor assembly 22 is a box shaped structure that encircles vertical member 21. Inside the motor assembly 22, there should be an electrical motor that drives geared Pinions. The Pinions will run along the toothed surface of rack 24, and hence convert the rotational torque of the electrical motor into vertical linear movement. Once enabled, the motor box 22 will provide a vertical upward/downward motion 70 along the rack track 24. The back support board 23 is a vertical board that is attached to the forward facing surface of motor box 22. So when the motor box 22 starts a vertical linear movement, the back support board 23 can also engage into the same vertical motion. The support board 23 functions similarly as the back support part of a conventional chair. The main difference in this invention is that this back supporting board is capable of engaging in vertical linear motions 70 instead of being a static element.

Figure 17:
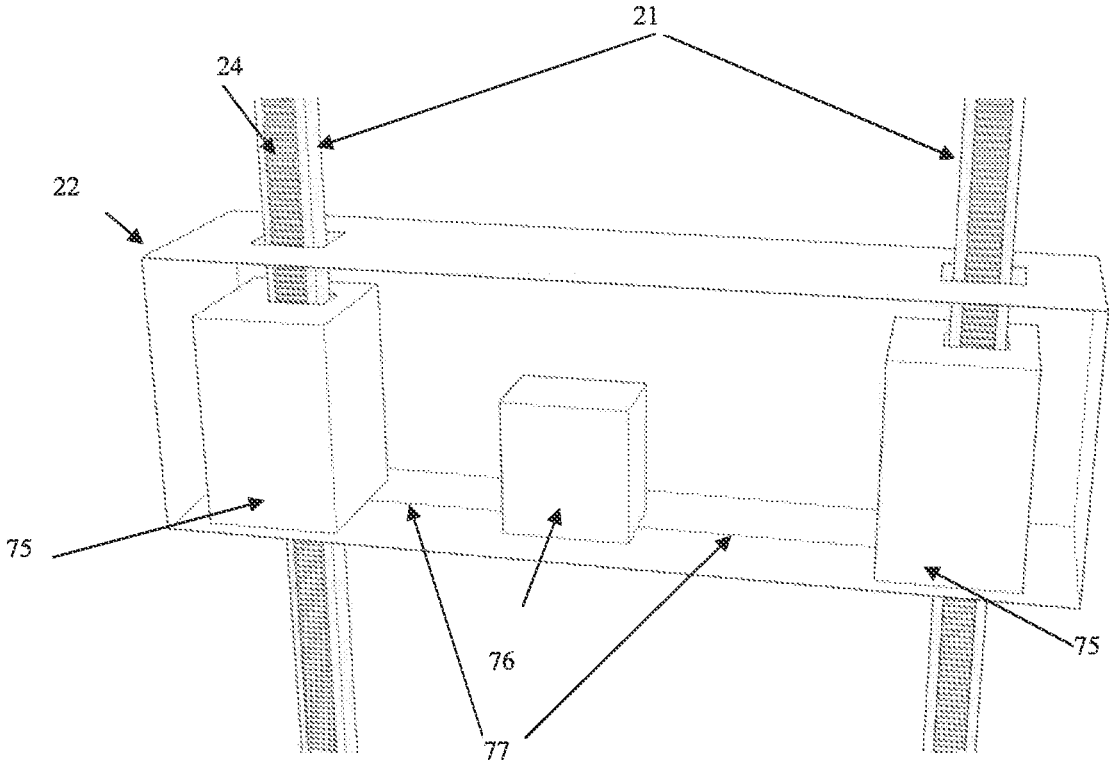
FIG. 17 is a perspective view of an example implementation of the motor box 22.

In FIG. 17, we give an example depiction of the motor assembly 22. There are two torque generating blocks 75, encircling the vertical member 21. Also, there is a controller unit 76, which are connected to torque generating blocks 75 through wires 77. Alternatively, controller unit 76 can be located somewhere else other than inside motor assembly 22, and it can be connected to torque generating block 75 through wireless as well as wire links. The torque generating block 75 can be activated such that it will climb up the geared pinions on track 24. Since the torque generating block 75 is attached with motor box 22, when 75 climb up or down alone track 24, the motor box 22 will also engage into vertical motion and hence lift the back support board 23 attached to it.

Figure 3:
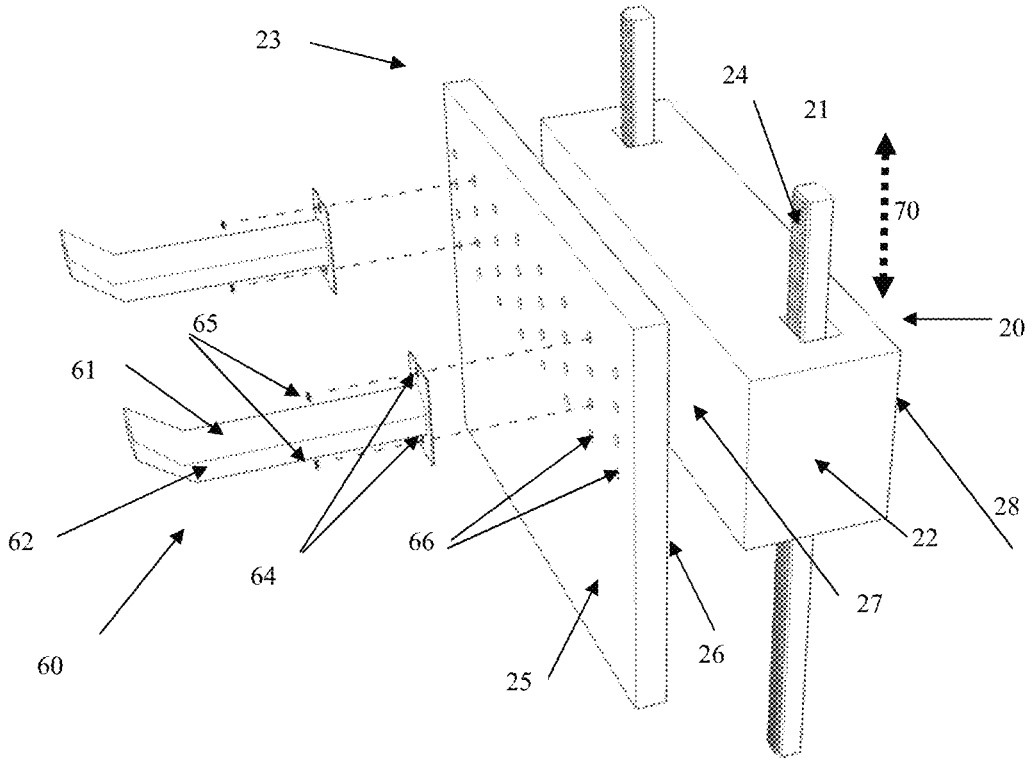
FIG. 3 is an exploded perspective view of lift assembly 20 and lift handle assembly 60 for Embodiment A of the present invention in FIG. 1
Figure 4:
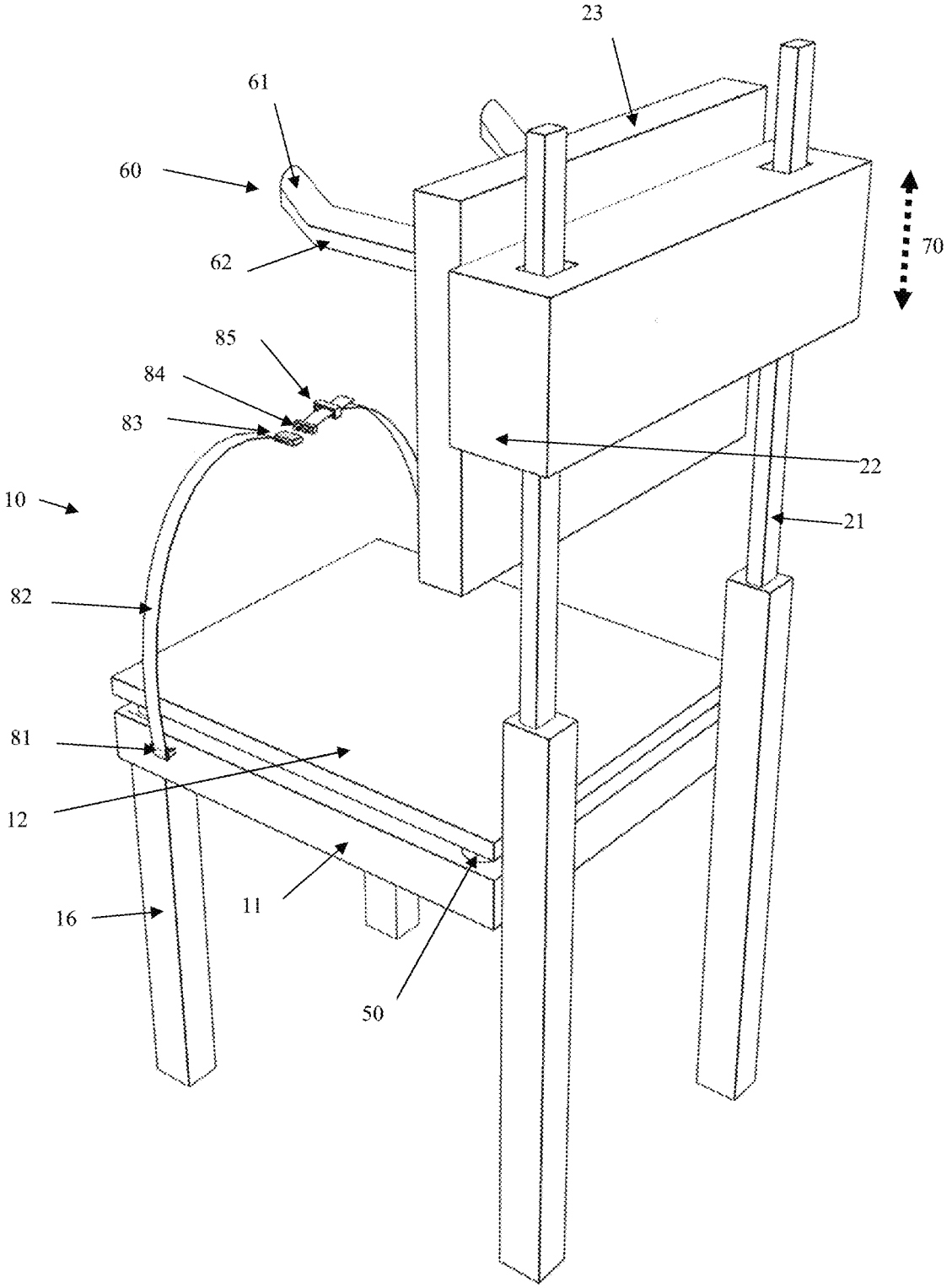
FIG. 4 is a back perspective view of the Embodiment A of the proposed chair in FIG. 1.
Figure 5:
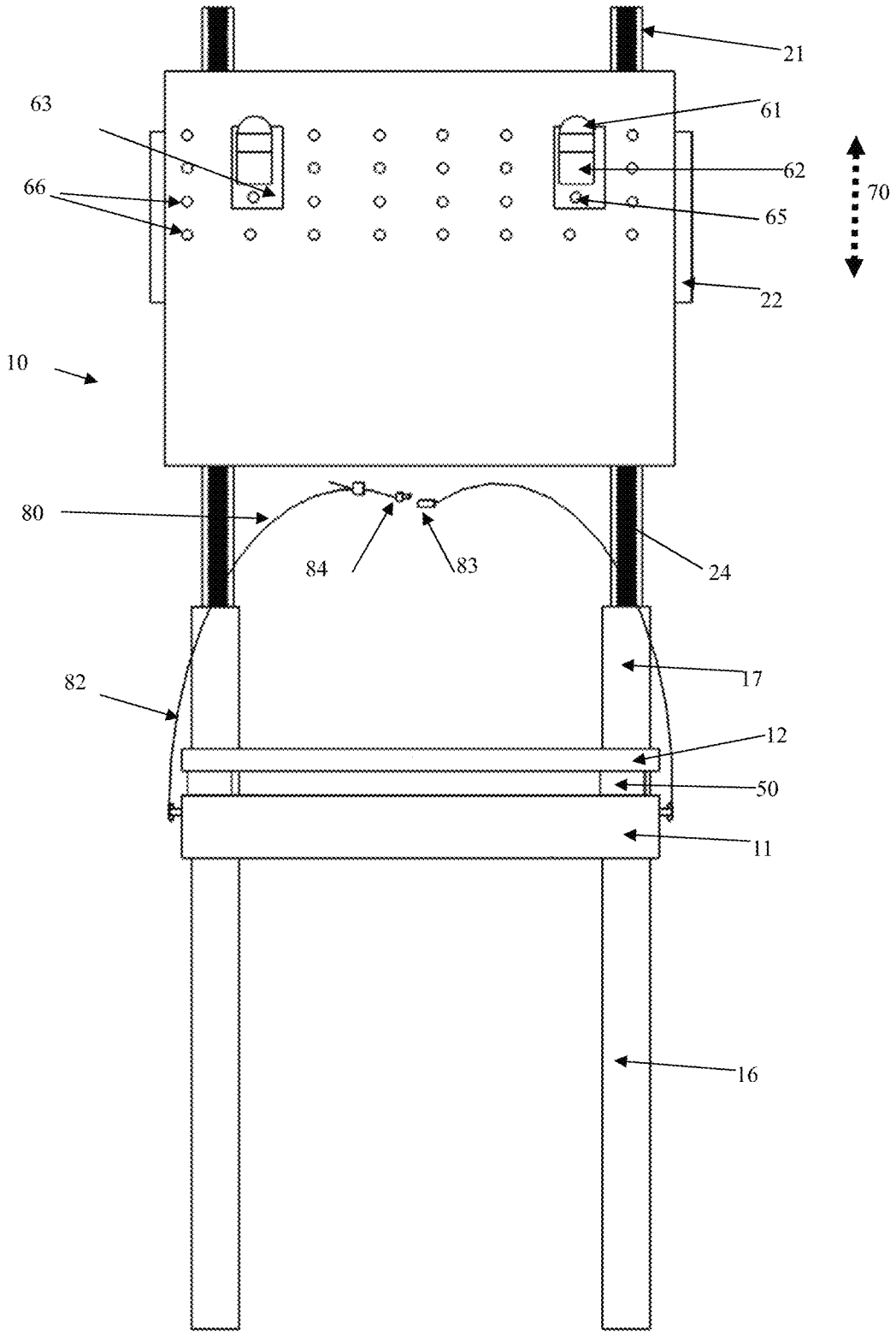
FIG. 5 is a front view of the Embodiment A of the proposed chair in FIG. 1.
Figure 6:
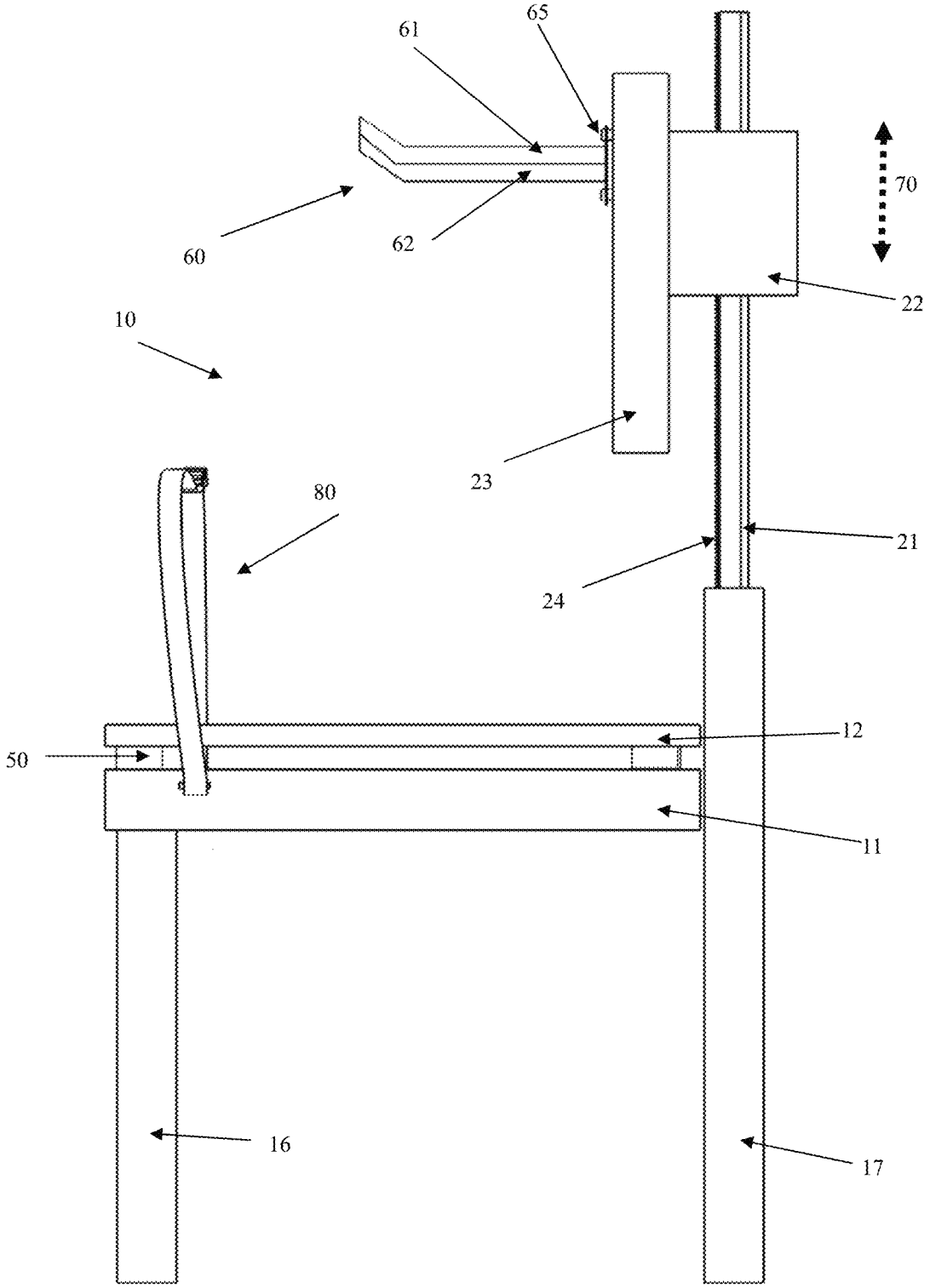
FIG. 6 is a side view of the Embodiment A of the proposed chair in FIG. 1.
Figure 7:
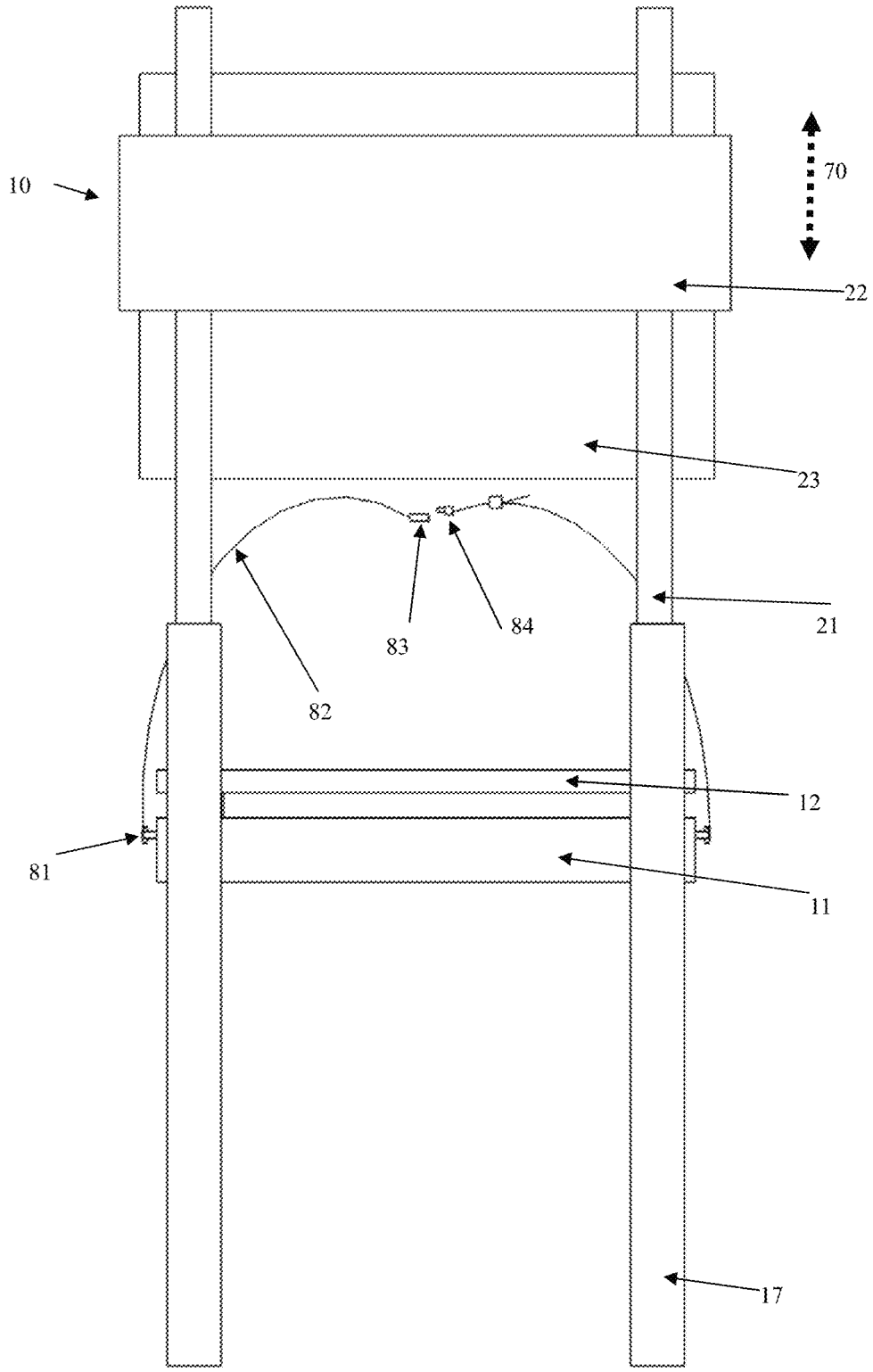
FIG. 7 is a back view of the Embodiment A of the proposed chair in FIG. 1.
Figure 8:
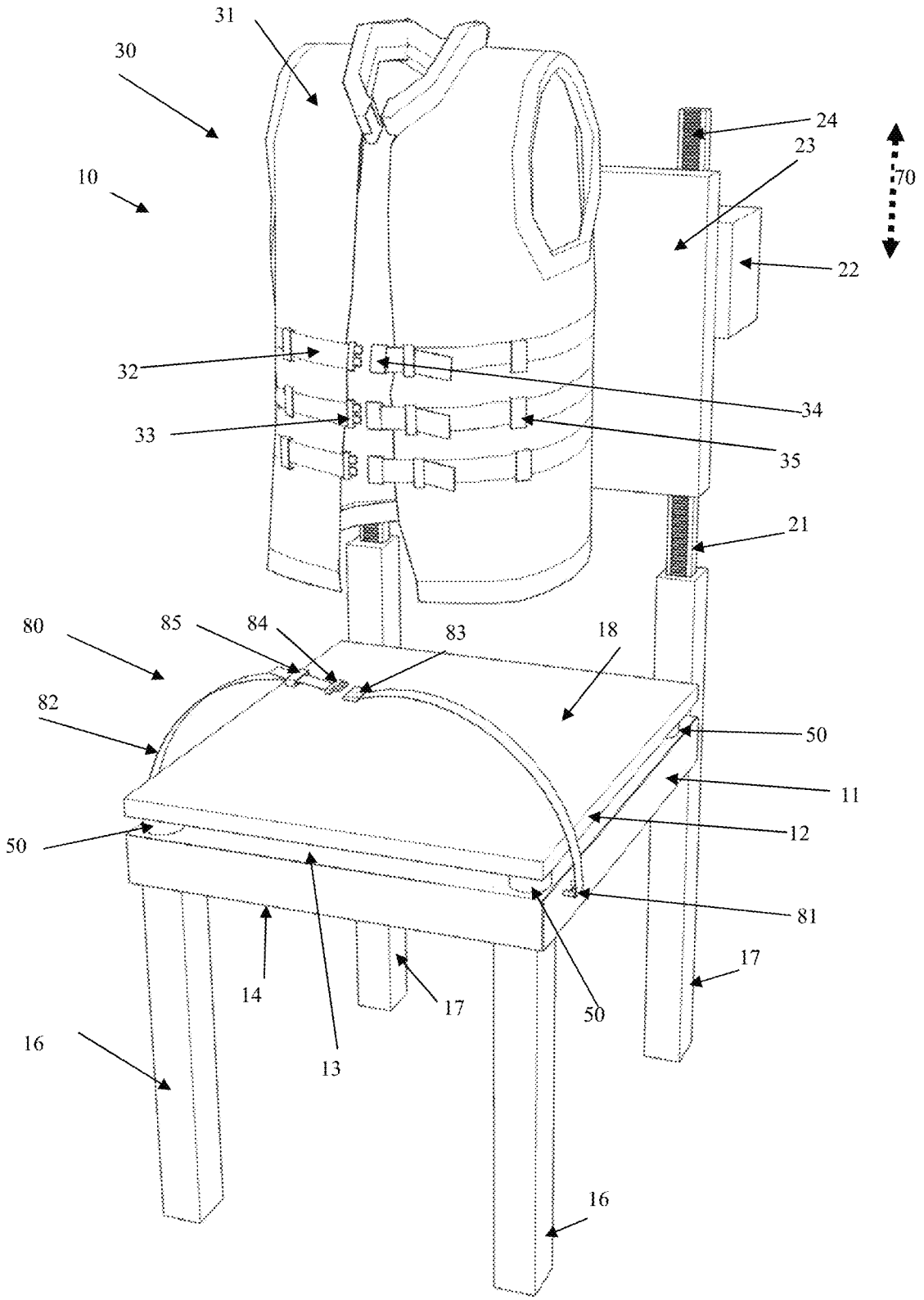
FIG. 8 is a front perspective view of Embodiment B of the back lifting chair.
Figure 18:
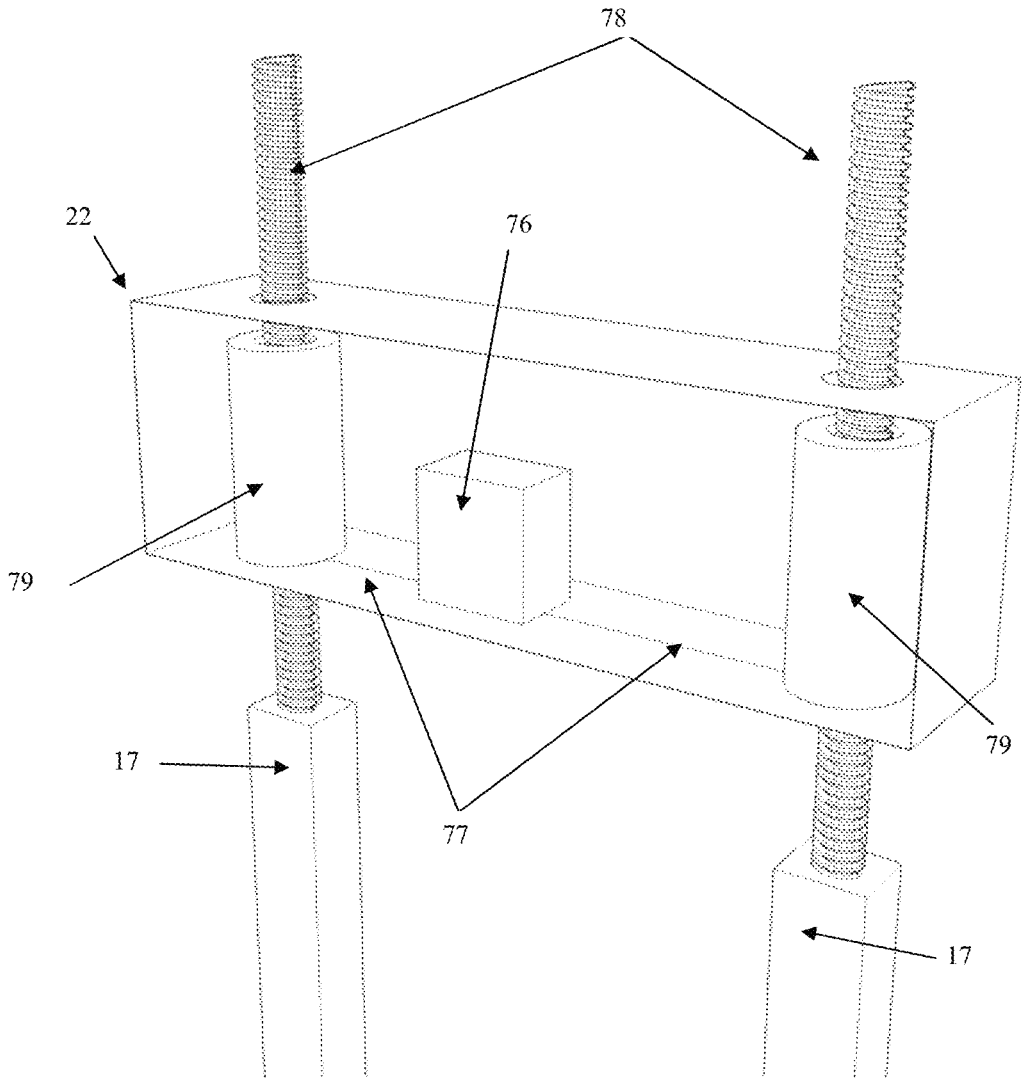
FIG. 18 is a perspective view of another example implementation of the motor box 22.

The main purpose of motor box 22 is to provide a vertical motion 70 for the back board 23. In FIG. 3 we have used a motor box 22 to generate torque which subsequently drives the motor box 22 alone the vertical rack track 24. However, there are many alternative ways to drive the back supporting board 23 in a vertical motion 70. In FIG. 18, we give another implementation of the motor box. In this example, the vertical member 21 is replaced with a vertical long lead screw 78. The screws 78 will be located directly above rear leg member 17. Inside motor box 22, the two torque generating boxes 75 are replaced with two cylinder shaped torque generating boxes 78. The rest of blocks, such as controller unit 76 and connection wires 77 remain the same. When the controller unit 76 activates the motion 70, the torque generating units 79 will climb up and down the lead screw 78, and hence lift up the attached motor box 22 and back support board 23 into vertical motions.

The possible power source can be manually steered by the user, or electricity, or hydraulic power, or other types of power supplies, as long as they produce vertical motion 70 for back board 23 and box structure 22. For a few examples, the lifting mechanisms in standard forklifts, elevator systems, or horizontal movement mechanisms in automobile power seats can all be adopted and modified here, as long as they provide a vertical motion 70 for the supporting board 23 and the lifting handle 60 on it.

Directly above seat board 12 is the optional thigh restraint assembly 80, which consists of the belt element 82, attachment fixture element 81, restraint element 85, the male buckle elements 84 and female receptacle buckle elements 83. The fixture elements 81 will attach the thigh restraint assembly 80 to the side of seat board 12 (or 11) through straps 82. The belt element 82 run around the user's thighs (or knees) and is capable to fasten sitter's thigh to the seat board 12. When the lift assembly 60 engages in a uplifting motion 70, a strong force might be able to completely or partially raise the sitter's torso from the seat board 12, and the sitter's thigh will be gradually hauled up and away from the seat board 12. When the sitter is partially or completely detached from seat board 12, he may has discomfort feeling. The restraint assembly 80 is employed here to ensure the sitter's thigh is always attached to the seat board 12 and prevent any such discomfort feeling. The buckle elements 83 and 84 and restraint element 85 should allow the belts 82 to be fastened or loosen freely, which gives sufficient resistance to ensure the seat's thigh is always making contact with seat board 12. In the mean time, the buckle elements 83/84 should also be easily released if the user needs to get out of the chair or terminate the lifting operation. Note the adoption of restraint assembly 80 is optional, and it is desirable to have good size and shape on belt element 82 to make sure the sitter has maximum comfort.

In a preferred way to implement this proposed invention, there should be a controller device build inside the chair, such as the controller unit 76 in FIG. 17. This controller device will be able to read the pressure reading from the sensors 50, either through wire line links or wireless links, and then control the electrical or hydraulic mechanism to lift the back supporting board 23. The exact torque (or force) and duration of the lifting action is determined by a control program operating inside the controller device which resides either inside motor box 22 or other parts of the chair. This control program should use an algorithm to carry out its lifting operation. For example, this algorithm can lift a fixed or programmable weight such as 20 kilograms, or a fixed or programmable percentage of the sitter's total weight. In an ideal implementation, the controller device can download the lifting setting configuration from a wire line link or a wireless link from an outside computer device (which is not shown in our figures). This lifting configuration can be available from internet source or other sources, or it can also be based on advice from a medical professional. For example, based on the sitter's weight, the lifting algorithm can issue commands to provide zero lifting force for the first 10 minutes of sitting period, and 20% of the sitter's total weight for the next 1 hour, and 40% of the sitter's total weight for the next 1 hour. After that, the controller device will issue an audio or visual warning to alert the sitter to get out of the chair and use some walking exercises to relief his spine from long term stress.

On back board 23, there are multiple screw holes depicted as 66 in FIG. 1 and FIG. 3. These holes are spaced horizontally and vertically at equal distances on the element 23. These holes are used to attach the lift handle assembly 60. The handle assembly 60 consists of the lower horizontal bar 62, top support pad 61, attachment plate 63 and screw holes 64. The two lift handles 60 need to be placed under the arm pit or axilla of the user. To accommodate the many sizes, weights and heights of various users, the lift handle assembly 60 needs to be moved around at the different positions around the back board 23. Once the ideal location is identified, the lift handle should be permanently fastened onto elements 23 at two screw holes 66 using screws 65 through the two screw holes 64. Once attached to 23, the lift handle 60 will be directly under the sitter's axillae. So once back board 23 and Motor box 22 engage in vertical motion 70, the sitter will be lifted up through the handle assembly 60 under his axilla. This process is best depicted in FIG. 2, in which the sitter is depicted as element 1.

In FIG. 3, a closed up exploded perspective depiction of the lift assembly 20 is provided. It can be seen that the back board 23 has screw holes 66 evenly spaced both horizontally and vertically on its forward facing surface 25. The lift handle assembly 60 should be affixed to element 23 using the screws 65 through screw holes 64. The back board has both forward facing surface 25 and backward facing surface 26. Correspondingly, the motor box also has forward facing surface 27 and backward facing surface 28. The backward facing surface 26 on element 23 should be directly attached to the forward facing surface 27 on 22. Once elements 23 and 22 are firmly fastened, the motion 70 from motor box 22 will be delivered to lift handle 60 and effectively lift up the sitter through his axillae. The element 22 and 23 can be made into a single piece, combined through welding, joined together through screws or nails, or any other commonly used methods to attach two objects, as long as it provides a solid structure to convey the lifting force 70 from motor box 22 to the sitter.

In practice, there are several variations to mount the lift handle 60 onto chair 10. One variation is that the back support board 23 is detached from motor box 22. The support board 23 is permanently affixed to vertical member 17 (or 21) or horizontal member 11 or 12, so it becomes a static element and loses its mobility. On back support board 23, there are several openings, and these openings will allow the lift handle 60 to be directly attached to the motor box 22. So when Motor box 22 engages in vertical motion 70, the lift handle 60 will also move vertically through the opening on back board 23. Another alternative is that the support board 23 is permanently affixed to the vertical member 17 or 21, or horizontal member 12 or 11, and the motor box 22 is connected to lift handle 60 through the left or right side of support board 23 through a holding arm structure. This alternative will be further discussed in Embodiment C. The main advantage of these alternative designs is that a static back board 23 is widely used in conventional chair design. By modifying existing chairs, such as open holes on back support board 23, and adding lifting assembly 20 and lift handle assembly 60, a traditional chair can be converted into a back lift chair 10.

When a lifting force is applied on the user's axillae for a prolonged duration, the pressure under the user's arm will make the sitter un-comfortable. Therefore, it is important to have a pad 61 on top of the lift bar 62. The pad 61 can be made with soft materials such as foam, fabric or leather. Also, it is desirable to have good size and shape on the pad 61 that best match the sitter's body structure. Through proper design, the soft pad 61 will afford sufficient comfort when the sitter is partially or fully lifted. It is obvious that lift handles of various sizes, shapes, materials and designs should be considered to give the user maximum comfort. However, these different considerations all serve one unique purpose, which is to lift the sitter through his axillae in a healthy manner.

More detail of the preferred Embodiment A of chair 10 of the present invention can be found in FIG. 4 through FIG. 7.

The Embodiment A of the present invention can effectively lift up partially or fully the user's upper torso, and hence reduce the pressure on his lower spine and provide significant health benefit. However, since all the lifting force is exerted at his axilla area, even with the soft element 61, the sitter may still experience discomfort after long term of stress around his arms. It is desirable to employ some other methods to disperse the stress of the lifting force and reduce the discomfort to a minimum level. Toward this goal, we propose the Embodiment B of the present invention. In this embodiment, the hauling force is evenly scattered around the sitter's upper torso, and hence avoid the discomfort in his axilla area.

The Embodiment B is depicted in FIG. 8 through FIG. 11 The majority part of Embodiment B, such as leg assembly 16 and 17, the pressure sensors 50, the horizontal supporting boards 11 and 12, the vertical member 21, the thigh restraint assembly 80, as well as the motor box 22, are identical to those of Embodiment A. The main difference is that the lift handle assembly 60 in Embodiment A, which consists of elements 61 through 65, is removed in Embodiment B. Also, the screw holes 66 on back board 23 are also removed. Instead, a new lift vest assembly 30 is employed. The main part of vest assembly 30 is a vest 31. This vest element 31 is made of cloth or other fabrics that can be found on typical clothes. The function of element 31 is to tightly enclose the user's upper torso and drag it upward. Since this vest will sustain more stretching force than normal clothes, it should be made with thicker materials and designs to make it durable. On the other hand, it should be designed carefully to such that the user will be relaxed when being enclosed inside it. On vest 31, there are three strap belt elements 32. At the two ends of elements 32, there are the male buckle elements 33 and female receptacle buckle elements 34. The elements 32, 33, and 34 run around the sitter's torso and allow the user to fasten the belt using the buckle. When the vest assembly is lifted together with the support board 23, the lifting force will be conveyed from the element 23 to the belt elements 32, which in turn pass the force to the sitter's upper body. The buckle elements 33 and 34 should allow the belts to be fastened and locked in a tight manner, which gives sufficient resistance (no dislocation) even when the sitter is completely lifted from the seat board 12. In the mean time, the buckle elements should also be easily released if the user needs to get out of the chair or terminate the lifting operation.

Around the strap belt 32, there are several restraint members 35. These elements will make sure the belt elements 32 stay at fix locations on the vest 31 instead of sliding freely. With elements 35, the lifting force will not cause dislocation of the strap belt. In Embodiment B, we have shown 3 belt and buckle elements 32 through 34. However, it is obvious that various members of belt or buckle elements can be employed. It is understandable that the more belts and buckle elements around the user's torso, the more evenly the lifting force will be distributed, hence more comfort will be offered. However, more belt and buckle elements will be inconvenient for the user to adjust, and it will be harder to get out of the chair. So, the manufactures should carefully consider the number of belt elements 32. Also, when multiple belt and buckle elements are adopted on vest 31, they can be placed at various vertical locations. The highest belt can be wrapped around the users axilla area, and the lowest belt can be at the sitter's lower back area. With the multiple belts available, the user can tighten the specific belts that provide the most comfort and loosen the belts that give distress during the lifting actions.

Figure 9:
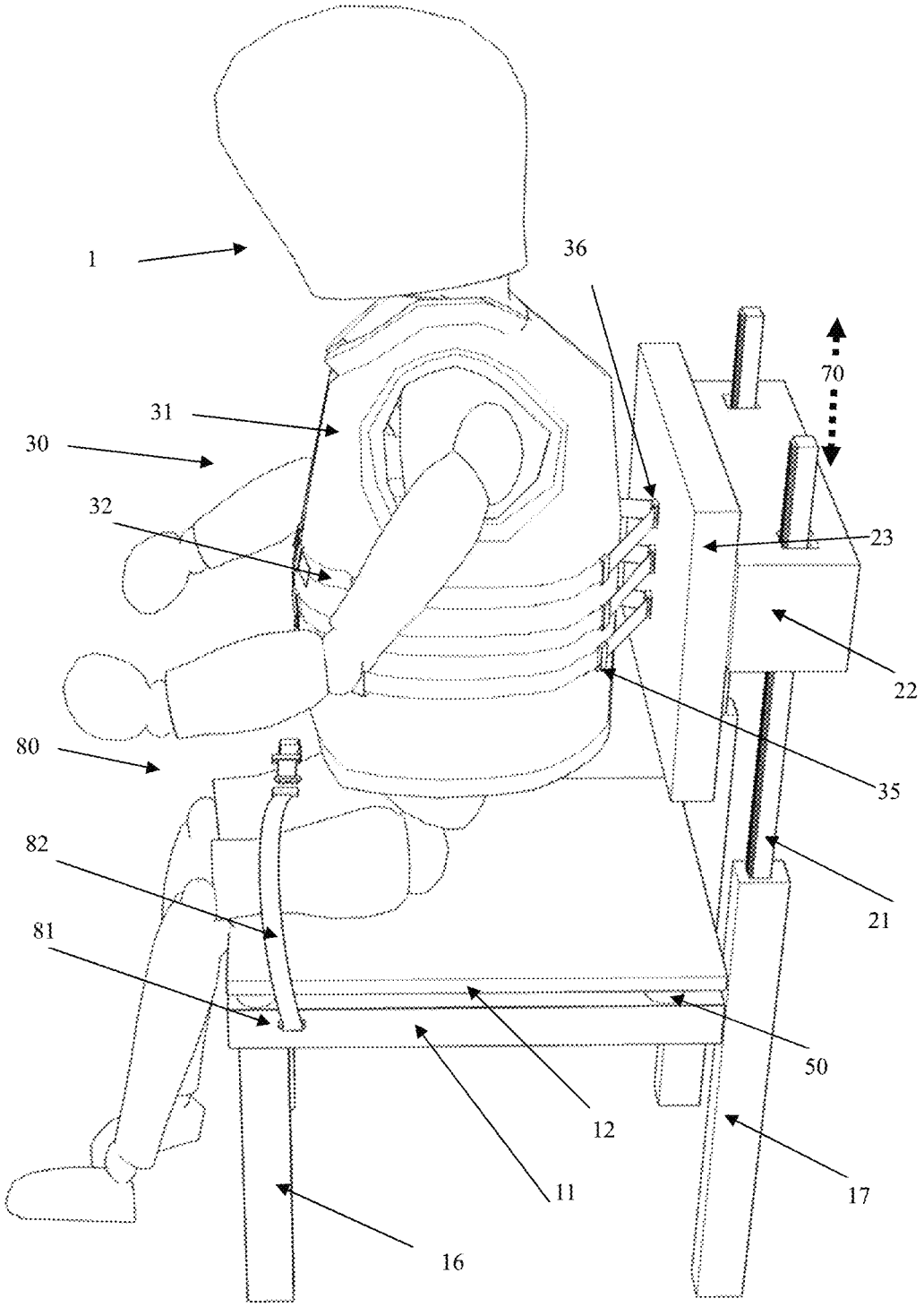
FIG. 9 is a side perspective view of Embodiment B of the chair in FIG. 8 with the user sitting in it.
Figure 10:
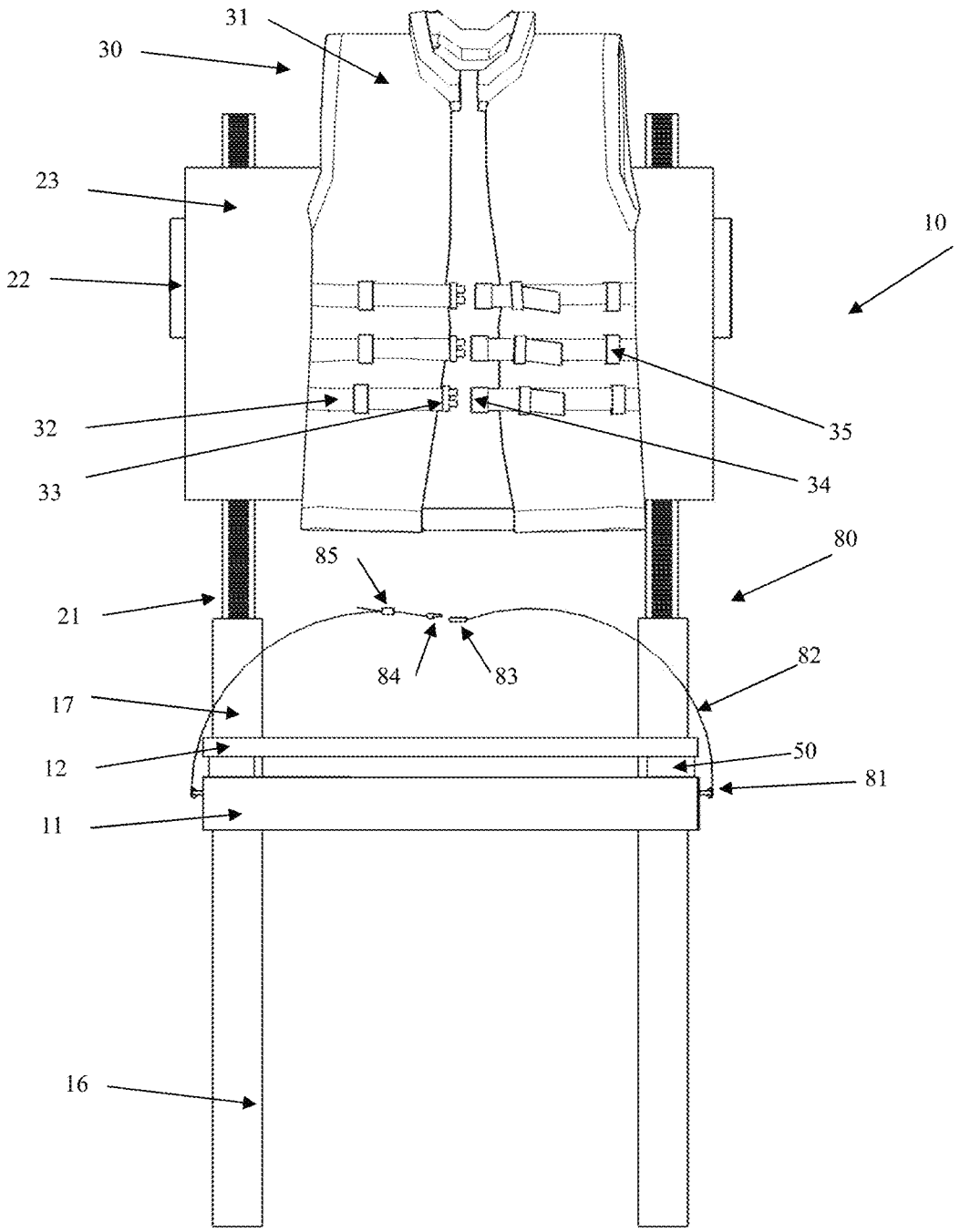
FIG. 10 is a front view of the Embodiment B of the proposed chair in FIG. 8.
Figure 11:
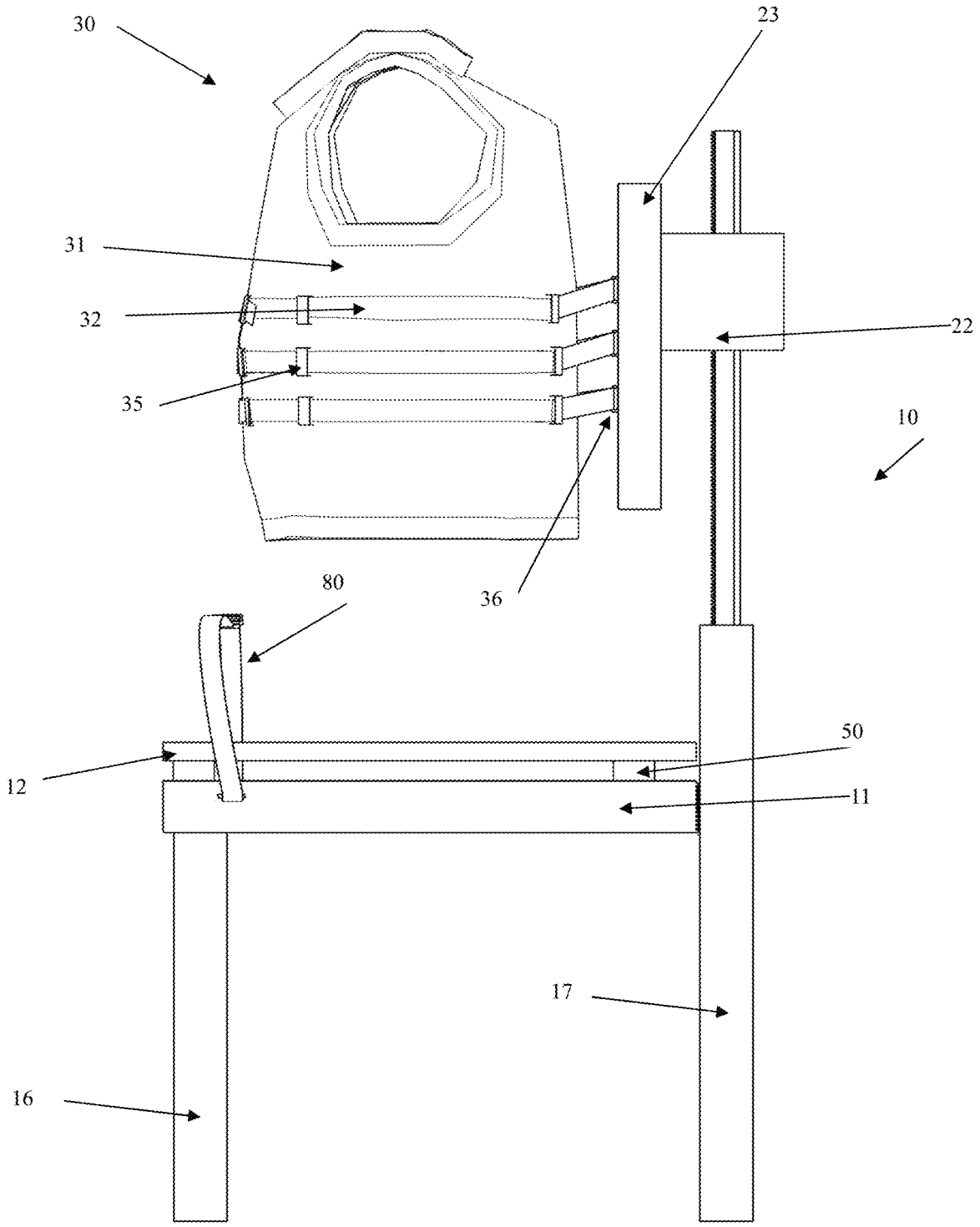
FIG. 11 is a side view of the Embodiment B of the proposed chair in FIG. 8.

To illustrate the Embodiment B of the present invention, FIG. 9 depicts the chair's operation from a side perspective angle. The sitter is depicted as element 1 in this figure. It can be noted that there are several belt restraint members 36 on the back support board 23. These elements 36 will attach the lift vest assembly 30 with the back board 23 through straps 32. When elements 23 engage in vertical motion 70, elements 36 will drag belts 32 into the same motion 70. Since the vest tightly wraps around the sitter l's body, the sitter's upper body will be lifted partially or completely from the seat board 12, and hence relief the pressure on his lumbar spine. In FIG. 10 and FIG. 11, more detail of Embodiment B is depicted in its front and side view.

The tightening action around the human body on the belts 32 in Embodiment B is critical for the lifting action. If the belts are loosely wrapped around the torso, there will not be enough resistance between the vest 31 and the user's torso. The belt will slip alone the human body and hence loss its grip and fail to lift the user. If the belts are intensely bound to the user's torso, it will provide enough resistance to lift up the upper body. However, the intense pressure and attrition from the lifting motion will make the user uncomfortable. Compare to Embodiment A, the main advantage of Embodiment B is that it distributes the lifting force evenly along the user's upper body, instead of focusing on a specific spot at the axilla area. In an advanced design, the tightening action on each belt 32 should be driven by a motor and controlled by a controller device. In this way, the optimal tightening and releasing of belt 32 will allow the sitter to enjoy the minimum amount of distress. However, to control the tightening on each belt presents a cost and implementation challenge. In what follows, we introduce Embodiment C which gives an alternative implementation to lift the user's body.

Figure 12:
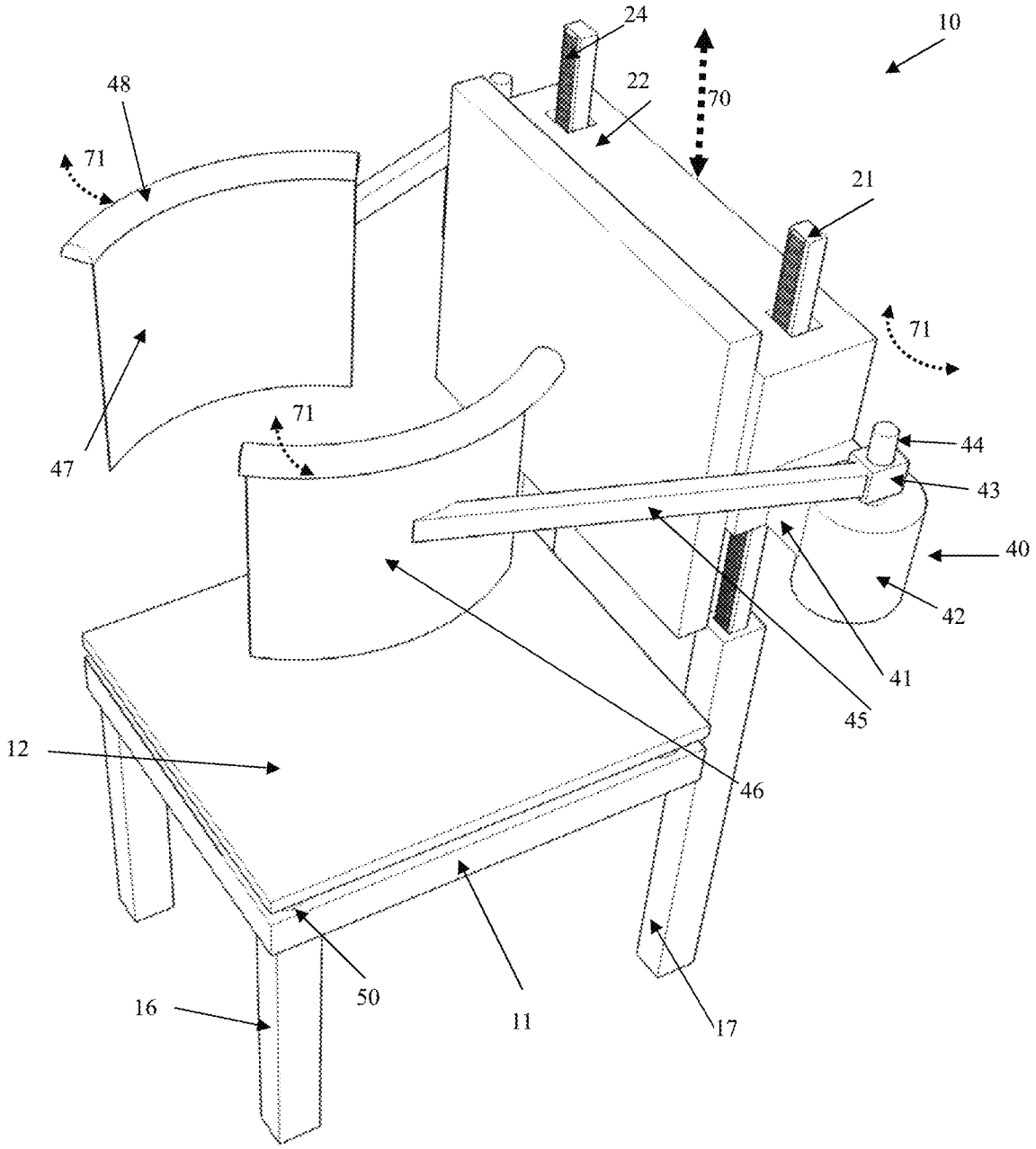
FIG. 12 is a perspective view of Embodiment C of the back lifting chair.

The Embodiment C is depicted in FIG. 12 through FIG. 16 The majority part of Embodiment C, such as leg assemblies 16 and 17, pressure sensors 50, horizontal supporting boards 11 and 12, the vertical member 21, as well as the motor box 22, are identical to those in Embodiment A and B. Note the thigh restraint assembly 80 is omitted from FIG. 12 through 16 to simplify the design. However, the restraint assembly 80 can also be adopted into Embodiment C when necessary. The main addition in Embodiment C is the holding assembly 40. The new assembly 40 consists of new elements 41 through 48. There are 2 holding assembly 40 elements which are located on the left and right sides of the motor box 22. They are attached to Motor box 22 through a connection element 41. The element 41 helps to pass the vertical lifting power from motor box 22 to other elements in 40, and also the electrical power lines and control wires passed through 41 to reach other parts of 40. The cylinder shaped element 42 is an electrical motor attached to element 41. Once powered and enabled, motor element 41 provides an axial motion 71 at its drive shaft element 44. On the drive shaft 44, there is a mounting hub element 43. It attaches the holding arm 45 and holding hand 46 to the motor shaft 44. The holding arm 45 is an arm like element that passes the axial motion 71 from the motor shaft 44 to the holding hand 46. The holding hand 46 has a half cylinder shape with an inner surface 47. Its main function is to press against the sitter's upper body using the axial motion 71. Once its inner surface 47 is tightly compressed on the sitter's torso, it will provide solid traction. When the motor box 22 engages in vertical lifting motion 70, the upward hauling power conducts through connection element 41, motor 42, mounting hub 43, and holding arm 45 to reach holding hand 46. With the solid traction on surface 47, the holding hand 46 will be able to lift up the sitter's upper body. Note, the inner surface 47 on holding hand 46 should have materials that provide maximum friction on this surface. Also, the contour of holding hand 46 is not necessarily half cylinder shape as shown in FIG. 12. It should be designed with the best material and shape to fit the sitter's body structure. A shape that fits a specific user's body will provide maximum comfort as well as sufficient traction when it makes contact with the sitter. In addition, the top edge of holding hand 46 has a supporting pad 48. As we mentioned before, the location of the holding hand 46 can be vertically adjusted by moving the motor box 22 together with the holding assembly 40. An ideal position of the holding hand 46 is that its top edge 48 is making firm contact with the sitter's axillae. So when the holding hand 46 is moving vertically, its upper edge is also pushing the sitter's axillae. The sitter will be lifted by both the push on his axillae and the upward friction on the surface 47. Since the lifting power is distributed in several different contact points, the sitter will experience minor distress in these lifting actions. For a similar reason as in Embodiment A, a support pad 48 is employed at the top edge of holding hand 46. This pad should be made of soft materials such as foam or leather so that when the holding hand 46 is pushing up the sitter's axillae, the soft materials will absorb the pressure and make the sitter more comfortable.

Figure 13:
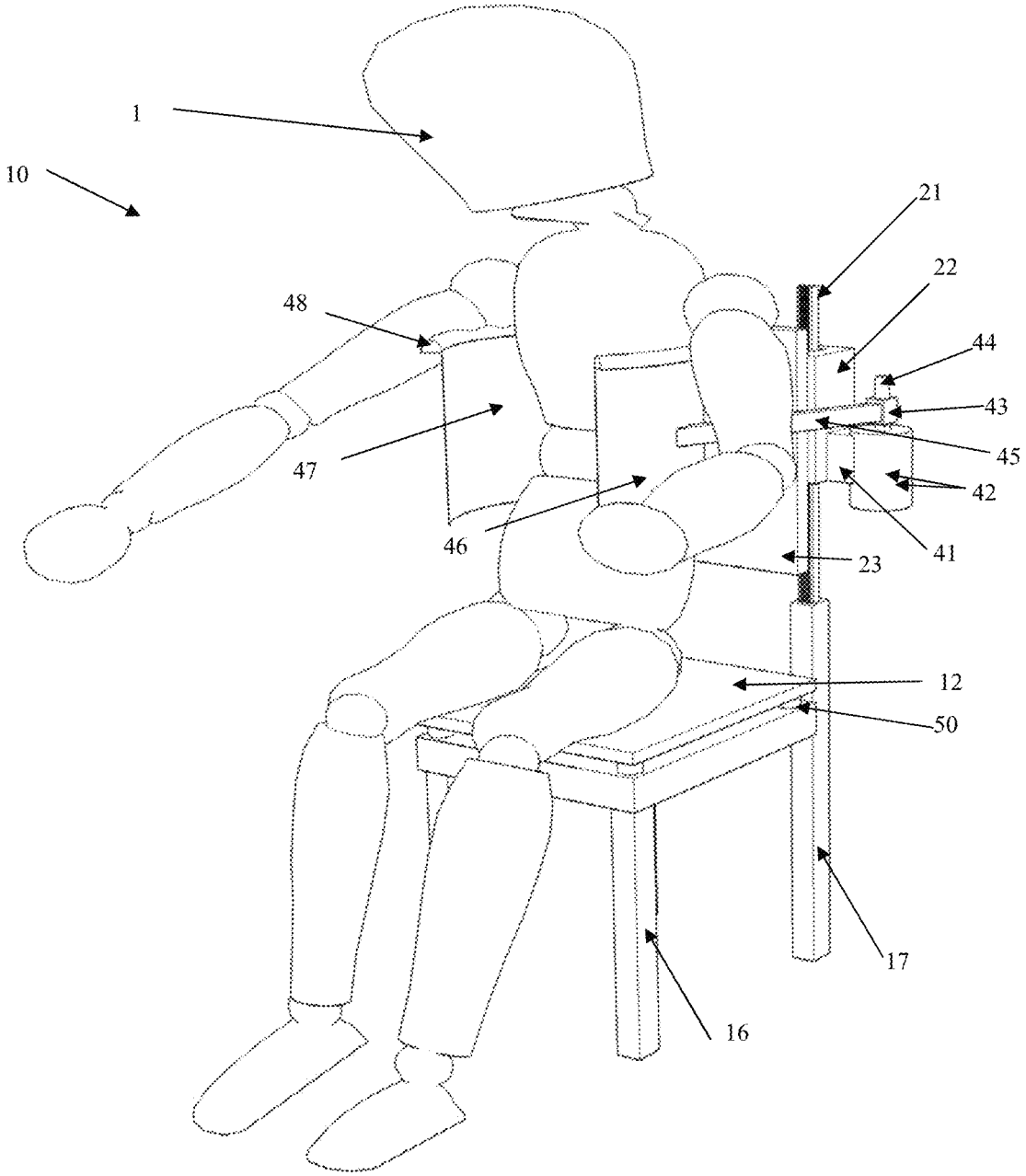
FIG. 13 is a perspective view of the Embodiment C of the chair in FIG. 12 with the user sitting in it.
Figure 14:
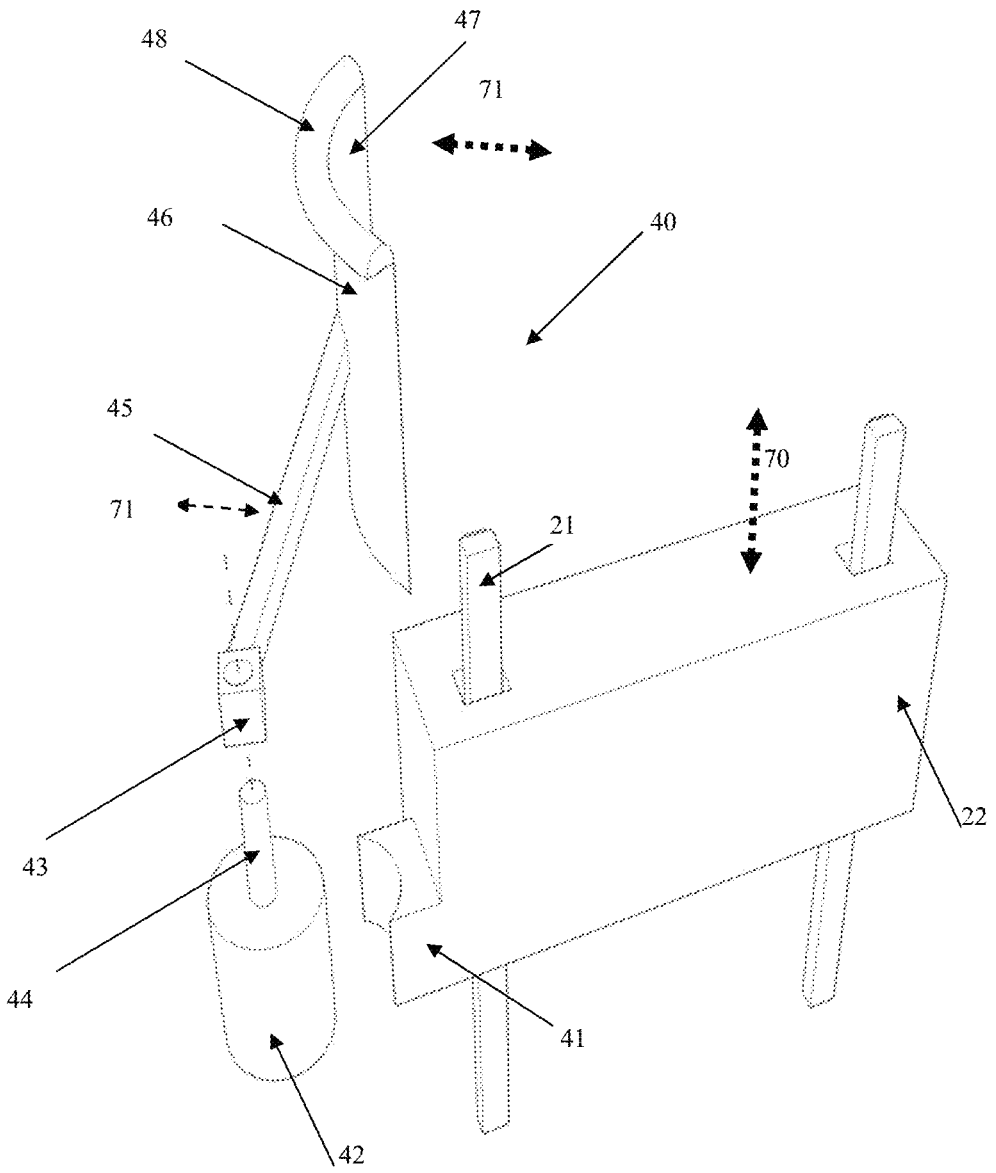
FIG. 14 is an exploded perspective view of the holding assembly 40 for Embodiment C of the proposed chair in FIG. 12.
Figure 15:
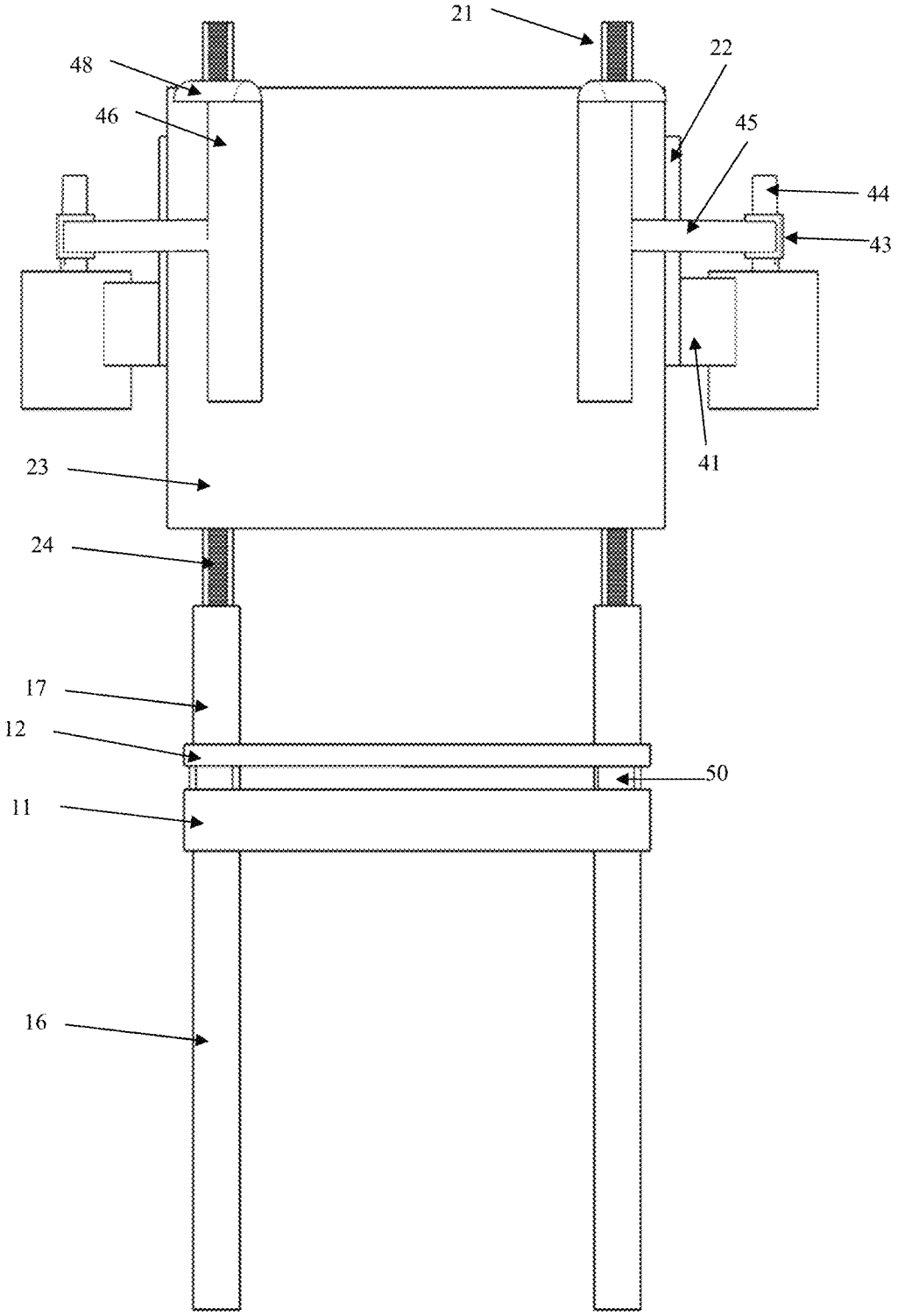
FIG. 15 is a front view of the Embodiment C of the proposed chair in FIG. 12.
Figure 16:
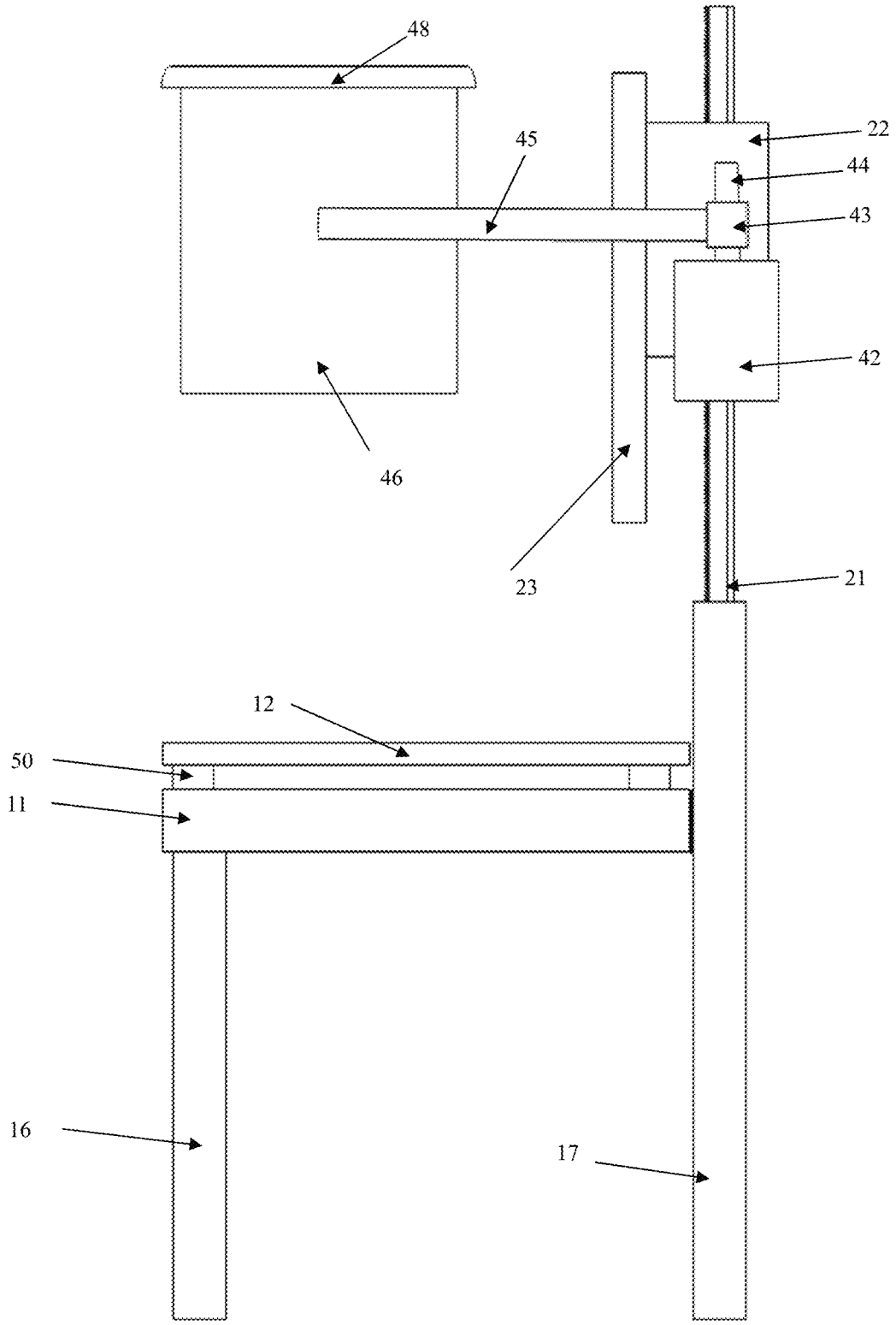
FIG. 16 is a side view of the Embodiment C of the proposed chair in FIG. 12.

In FIG. 14, an exploded perspective view of the holding assembly 40 is provided. It can be seen that when the motor elements 41 is activated, it provides an axial motion 71, and the axial motion 71 is passed down to holding hand 46 through holding arm 45. The holding hand 46 will press on the sitter's side like a pairs of big hands holding on the sitter's side. Once the motor box 22 initiates an upward motion 70, the lifting force will travel through holding assembly 40 and pass on to the sitter. Overall, the Embodiment C acts like a pair of mechanical hands holding onto the side of the sitter, and then lifting him up using an upward lifting force 70. In FIG. 13 another illustration of the Embodiment C with a user inside chair 10 is depicted. It can be seen that the sitter's body is enclosed by chair 10 and his upper torso being lifted by holding assembly 40. In FIG. 15 and FIG. 16, the front and side views of Embodiment C are also given for better understanding of this implementation.

In Embodiment C, the back support board 23 can be detached from motor box 22, and becomes a static element as in a traditional chair. It is also obvious that by adding motor box 22 and holding assembly 40, a traditional chair can be converted into a back lift chair 10 as in Embodiment C.

Another obvious improvement for the proposed back lifting chair 10 is that it can be combined with other types of chairs, such as massage chairs or rocking chairs, yet it should maintain most of its health advantage. Also, the user should be able to perform most of his normal activities without any trouble.

The proposed invention, including all its 3 embodiments, can be easily employed to the seat on a moving communication vehicle. In this case, it is desired to have an automatic or manual lock and release mechanism. It is especially important for Embodiment B and Embodiment C, in which a fast release mechanism should be installed on the lift vest assembly 30 or holding assembly 40. So, when the vehicle encounters an accident, the vest assembly 30 or holding assembly 40 can be immediately and automatically released, allowing the user to get away from his seat.

While several alternative embodiments of the present invention have been described, it is readily clear to those skilled in the art that the present invention is subjected to all kinds of variation, reorganization, combination and simplification without departing from the spirit and scope of this invention. It is intended, therefore, by this document to cover all such modifications and changes all falling within the scope and spirit of the invention.

What is claimed:

1. A seating device for an occupant, comprising:

a leg assembly comprising at least one leg member and at least two connecting members each having a chamber with an opening at the top, the inside of each chamber having a means for interlocking distributed along at least one surface of the inside of each chamber;

a horizontal flat board member having an up facing surface and a down facing surface, the down facing surface of the horizontal flat board member attached to the top of the leg member, and attached to the connecting members;

a seat board member having an up facing surface and a down facing surface;

a system for monitoring posture and weight distribution of the occupant, having a plurality of sensors attached between the up facing surface of the flat board member and the down facing surface of the seat board member, the plurality of sensors generating and transmitting pressure readings whenever a change in pressure in a force exerted on the seat board member occurs;

a lifting assembly for adjusting the posture and weight distribution of the occupant, comprising, a back supporting board having a plurality of holes;

at least one holding means for securing the occupant to the seating device and reducing pressure on the axillae area of the occupant when the lifting assembly is activated;

an attachment means for removably and adjustably attaching the at least one holding means via the plurality of holes to a front surface of the back supporting board;

vertically disposed parallel members having a means for interlocking distributed along a front surface of each vertical member, and forming a vertical sliding track;

a housing having at least two parallel openings extending from the top to the bottom of the housing, each having a chamber with an interlocking means for slidably receiving the vertically disposed parallel members, a front facing surface of the housing being attached to a back surface of the back supporting board;

a torque generating means disposed in said housing, said torque generating means causing the lifting assembly to move in an upward or downward vertical movement along the tracks of the vertical members to adjust the posture and weight distribution of the occupant;

a programable control unit disposed in said housing, said control unit receiving readings on the posture, weight distribution and sitting duration of an occupant, analyzing the readings based on a predetermined threshold, and activating the lifting assembly to adjust the posture and weight distribution of the occupant; and whereby the monitoring system, the control unit, and the torque generating means communicate via a series of signals to monitor the posture, weight distribution, and sitting duration of an occupant of a seating device, and activate the lifting assembly to adjust the posture and weight distribution of an occupant.

2. The seating device of claim 1, wherein the up facing surface of the seat board member may be padded with a material selected from a group consisting of foam, leather, or fabric.

3. The seating device of claim 1, wherein the front surface of the back supporting board may be padded with a material selected from a group consisting of foam, leather, or fabric.

4. The seating device of claim 1, wherein the plurality of sensors may transmit readings by wire or wirelessly to a receiving device configured to receive the readings.

5. The seating device of claim 1, wherein the monitoring system is comprised of at least three sensors.

6. The seating device of claim 1, wherein the at least one holding means further includes one or more holding members adaptable to receive and support the upper torso of the occupant.

7. The seating device of claim 6, wherein the at least one holding means may further comprise an adjustable securing means for further restraining the occupant.

8. The seating device of claim 6, wherein a top surface of the at least one holding means may be covered with a material selected from a group consisting of foam, leather, or fabric.

9. The seating device of claim 1, wherein the interlocking means of the vertical members engage with the interlocking means of the corresponding connecting members to lock the lifting assembly into position, and to facilitate the vertical movement of the lifting assembly.

10. The seating device of claim 1, wherein the interlocking means of the vertical members engage with the interlocking means of the chambers of the housing to securably attach the housing to the vertical members.

11. The seating device of claim 1, wherein the control unit further comprises a controller having a control program stored therein, said control unit being operatively connected to the plurality of sensors so as to receive the pressure readings.

12. The seating device of claim 11, wherein the control unit may be connected to the plurality of sensor via a wired or wireless connection.

13. The seating device of claim 11, wherein the control unit is operatively connected to the torque generating means so as to issue signals dictated by the control program to said torque generating means for adjusting the lifting assembly.

14. A seating device for an occupant, comprising:

a leg assembly comprising two front leg members and two rear leg members having a chamber with an opening at the top, the inside of the chamber having a means for interlocking distributed along at least one surface of the inside of the chamber;

a horizontal flat board member having an up facing surface and a down facing surface, the down facing surface of the horizontal flat board member attached to the top of the two front leg members, and the two rear leg members attached to the horizontal flat board member at the side opposing the two front leg members, the two rear leg members extending above the up facing surface of the horizontal flat board member;

a seat board member having an up facing surface and a down facing surface;

a thigh restraint assembly comprising two belt members securably affixed to opposing sides of the horizontal flat board member and extending above the seat board member, each belt member having a fastening means for engaging the opposing belt member and securing the occupant to the seating device;

a system for monitoring posture and weight distribution of the occupant, having a plurality of sensors attached between the up facing surface of the flat board member and the down facing surface of the seat board member, the plurality of sensors generating and transmitting pressure readings whenever a change in pressure in a force exerted on the seat board member occurs;

a lifting assembly for adjusting the posture and weight distribution of the occupant, comprising, a back supporting board having a plurality of holes;

at least one holding means for holding the upper torso of the occupant to the back supporting board when the lifting assembly is activated;

an attachment means for removably and adjustably attaching the at least one holding means via the plurality of holes to a front surface of the back supporting board;

vertically disposed parallel members having a means for interlocking distributed along a front surface of each vertical member, and forming a vertical sliding track;

a housing having at least two parallel openings extending from the top to the bottom of the housing, each having a chamber with an interlocking means for slidably receiving the vertically disposed parallel members, a front facing surface of the housing being attached to a back surface of the back supporting board;

a torque generating means disposed in said housing, said torque generating means causing the lifting assembly to move in an upward or downward vertical movement along the tracks of the vertical members to adjust the posture and weight distribution of the occupant;

a programmable control unit disposed in said housing, said control unit receiving readings on the posture, weight distribution and sitting duration of an occupant, analyzing the readings based on a predetermined threshold, and activating the lifting assembly to adjust the posture and weight distribution of the occupant;

whereby the thigh restraining assembly securably restrains the occupant to the seating device for further support and preventing injury; and whereby the monitoring system, the control unit, and the torque generating means communicate via a series of signals to monitor the posture, weight distribution, and sitting duration of an occupant of a seating device, and activate the lifting assembly to adjust the posture and weight distribution of an occupant.

15. The seating device of claim 14, wherein the up facing surface of the seat board member may be padded with a material selected from a group consisting of foam, leather, or fabric.

16. The seating device of claim 14, wherein the at least one holding means further includes one or more holding members adaptable to receive and support the upper torso of the occupant.

17. The seating device of claim 16, wherein the at least one holding means may further comprise an adjustable securing means for further restraining the occupant.

18. The seating device of claim 14, wherein the interlocking means of the vertical members engage with the interlocking means of the corresponding rear leg members to lock the lifting assembly into position, and to facilitate the vertical movement of the lifting assembly.

19. The seating device of claim 14, wherein the interlocking means of the vertical members engage with the interlocking means of the chambers of the housing to securably attach the housing to the vertical members.

20. The seating device of claim 14, wherein the control unit further comprises a controller having a control program stored therein, said control unit being operatively connected to the plurality of sensors so as to receive the pressure readings.

21. The seating device of claim 20, wherein the control unit may be connected to the plurality of sensor via a wired or wireless connection.

22. The seating device of claim 20, wherein the control unit is operatively connected to the torque generating means so as to issue signals dictated by the control program to said torque generating means for adjusting the lifting assembly.

23. A seating device for an occupant, comprising:

a leg assembly comprising two front leg members and two rear leg members having a chamber with an opening at the top, the inside of the chamber having a means for interlocking distributed along at least one surface of the inside of the chamber;

a horizontal flat board member having an up facing surface and a down facing surface, the down facing surface of the horizontal flat board member attached to the top of the two front leg members, and the two rear leg members attached to the horizontal flat board member at the side opposing the two front leg members, the two rear leg members extending above the up facing surface of the horizontal flat board member;

a lifting assembly for adjusting the posture and weight distribution of the occupant, comprising, a back supporting board having a plurality of holes;

at least one holding means for holding the upper torso of the occupant to the back supporting board when the lifting assembly is activated;

an attachment means for removably and adjustably attaching the at least one holding means via the plurality of holes to a front surface of the back supporting board;

vertically disposed parallel members having a means for interlocking distributed along a front surface of each vertical member, and forming a vertical sliding track;

a housing having at least two parallel openings extending from the top to the bottom of the housing, each having a chamber with an interlocking means for slidably receiving the vertically disposed parallel members, a front facing surface of the housing being attached to a back surface of the back supporting board;

a torque generating means disposed in said housing, said torque generating means causing the lifting assembly to move in an upward or downward vertical movement along the tracks of the vertical members to adjust the posture and weight distribution of the occupant;

a programmable control unit disposed in said housing, said control unit capable of activating the lifting assembly to adjust the posture and weight distribution of the occupant; and whereby the control unit and the torque generating means communicate via a series of signals to adjust the posture and weight distribution of an occupant of a seating device.

24. The seating device of claim 23, wherein the up facing surface of the horizontal flat board member may be padded with a material selected from a group consisting of foam, leather, or fabric.

25. The seating device of claim 23, wherein the at least one holding means further includes one or more holding members adaptable to receive and support the upper torso of the occupant.

26. The seating device of claim 25, wherein the at least one holding means may further comprise an adjustable securing means for further restraining the occupant.

27. The seating device of claim 23, wherein the interlocking means of the vertical members engage with the interlocking means of the corresponding rear leg members to lock the lifting assembly into position, and to facilitate the vertical movement of the lifting assembly.

28. The seating device of claim 23, wherein the interlocking means of the vertical members engage with the interlocking means of the chambers of the housing to securably attach the housing to the vertical members.

29. The seating device of claim 23, wherein the control unit further comprises a controller having a control program stored therein, said control unit being operatively connected to the torque generating means so as to issue signals to said torque generating means for adjusting the lifting assembly.

30. The seating device of claim 29, wherein the control unit may be manually configured to activate the torque generating means at a fixed sitting duration.

31. A seating device for an occupant, comprising:

a leg assembly comprising two front leg members and two rear leg members having a chamber with an opening at the top, the inside of the chamber having a means for interlocking distributed along at least one surface of the inside of the chamber;

a horizontal flat board member having an up facing surface and a down facing surface, the down facing surface of the horizontal flat board member attached to the top of the two front leg members, and the two rear leg members attached to the horizontal flat board member at the side opposing the two front leg members, the two rear leg members extending above the up facing surface of the horizontal flat board member;

a seat board member having an up facing surface and a down facing surface;

a thigh restraint assembly comprising two belt members securably affixed to opposing sides of the horizontal flat board member and extending above the seat board member, each belt member having a fastening means for engaging the opposing belt member and securing the occupant to the seating device;

a system for monitoring posture and weight distribution of the occupant, having a plurality of sensors attached between the up facing surface of the flat board member and the down facing surface of the seat board member, the plurality of sensors generating and transmitting pressure readings whenever a change in pressure in a force exerted on the seat board member occurs;

a lifting assembly for adjusting the posture and weight distribution of the occupant, comprising, a back supporting board having a plurality of attachment means;

a vest with a front opening having a plurality of horizontal parallel belt members around a waist of the vest and securably affixed to the vest, each belt member having a plurality of restraining members spaced across the length of the belt member, and each belt member having a first end and a second end extending from opposing sides of the front opening of the vest and forming an adjustable fastening means when joined at the front of the vest;

a plurality of attachment means for removably and adjustably attaching the at least one supporting vest to a front surface of the back supporting board;

vertically disposed parallel members having a means for interlocking distributed along a front surface of each vertical member, and forming a vertical sliding track;

a housing having at least two parallel openings extending from the top to the bottom of the housing, each having a chamber with an interlocking means for slidably receiving the vertically disposed parallel members, a front facing surface of the housing being attached to a back surface of the back supporting board;

a torque generating means disposed in said housing, said torque generating means causing the lifting assembly to move in an upward or downward vertical movement along the tracks of the vertical members to adjust the posture and weight distribution of the occupant;

a programmable control unit disposed in said housing, said control unit receiving readings on the posture, weight distribution and sitting duration of an occupant, analyzing the readings based on a predetermined threshold, and activating the lifting assembly to adjust the posture and weight distribution of the occupant;

whereby the thigh restraining assembly securably restrains the occupant to the seating device for further support and preventing injury;

whereby the vest securably holds the upper torso of the occupant to the back supporting board to prevent the occupant from falling over, and holds the occupant when the lifting assembly is activated; and whereby the monitoring system, the control unit, and the torque generating means communicate via a series of signals to monitor the posture, weight distribution, and sitting duration of an occupant of a seating device, and activate the lifting assembly to adjust the posture and weight distribution of an occupant.

32. The seating device of claim 31, wherein the up facing surface of the seat board member may be padded with a material selected from a group consisting of foam, leather, or fabric.

33. The seating device of claim 31, wherein the at least one holding means further includes one or more holding members adaptable to receive and support the upper torso of the occupant.

34. The seating device of claim 33, wherein the at least one holding means may further comprise an adjustable securing means for further restraining the occupant.

35. The seating device of claim 31, wherein the interlocking means of the vertical members engage with the interlocking means of the corresponding rear leg members to lock the lifting assembly into position, and to facilitate the vertical movement of the lifting assembly.

36. The seating device of claim 31, wherein the interlocking means of the vertical members engage with the interlocking means of the chambers of the housing to securably attach the housing to the vertical members.

37. The seating device of claim 31, wherein the control unit further comprises a controller having a control program stored therein, said control unit being operatively connected to the plurality of sensors so as to receive the pressure readings.

38. The seating device of claim 37, wherein the control unit may be connected to the plurality of sensor via a wired or wireless connection.

39. The seating device of claim 37, wherein the control unit is operatively connected to the torque generating means so as to issue signals dictated by the control program to said torque generating means for adjusting the lifting assembly.

40. The seating device of claim 31, wherein the vest is made from thick materials or cloth for durability.

41. The vest of the seating device of claim 31, wherein the first end and the second end of each belt member interlock to form a buckle arrangement.

42. A seating device for an occupant, comprising:

a leg assembly comprising two front leg members and two rear leg members having a chamber with an opening at the top, the inside of the chamber having a means for interlocking distributed along at least one surface of the inside of the chamber;

a horizontal flat board member having an up facing surface and a down facing surface, the down facing surface of the horizontal flat board member attached to the top of the two front leg members, and the two rear leg members attached to the horizontal flat board member at the side opposing the two front leg members, the two rear leg members extending above the up facing surface of the horizontal flat board member;

a seat board member having an up facing surface and a down facing surface;

a system for monitoring posture and weight distribution of the occupant, having a plurality of sensors attached between the up facing surface of the flat board member and the down facing surface of the seat board member, the plurality of sensors generating and transmitting pressure readings whenever a change in pressure in a force exerted on the seat board member occurs;

a lifting assembly for adjusting the posture and weight distribution of the occupant, comprising, a back supporting board;

vertically disposed parallel members having a means for interlocking distributed along a front surface of each vertical member, and forming a vertical sliding track;

a housing having at least two parallel openings extending from the top to the bottom of the housing, each having a chamber with an interlocking means for slidably receiving the vertically disposed parallel members, a front facing surface of the housing being attached to a back surface of the back supporting board;

a torque generating means disposed in said housing, said torque generating means causing the lifting assembly to move in an upward or downward vertical movement along the tracks of the vertical members to adjust the posture and weight distribution of the occupant;

a programmable control unit disposed in said housing, said control unit receiving readings on the posture, weight distribution and sitting duration of an occupant, analyzing the readings based on a predetermined threshold, and activating the lifting assembly to adjust the posture and weight distribution of the occupant;

a holding assembly for holding the upper torso of the occupant upright and for lifting the occupant, comprising, two connecting members disposed on each side of the lifting assembly, each connecting member having a housing having two sides provided with an opening on each side, a first side of each connecting member connected to the housing of the lifting assembly and wired to the torque generating means, and a second side of each connecting member wired to the holding assembly;

two motor housings, each having a motor, each housing connected to the corresponding second side of the housing of the connecting members of the holding assembly;

two drive shafts, each connected to the corresponding motor and extending upward out of a top opening of the corresponding motor housing;

two mounting hubs, each receiving a corresponding driving shaft;

two holding arms, each connected to a corresponding mounting hub at one end, and each holding arm extending toward the front of the seating device;

two concave shaped holding members, each attached at an outer surface to a second end of the corresponding holding arm, each holding member having an inner surface facing toward the middle of the seating device for holding the side of the occupant's torso and providing traction;

two support pads, each disposed across the top edge of the corresponding holding members;

whereby the monitoring system, the control unit, and the torque generating means communicate via a series of signals to monitor the posture, weight distribution, and sitting duration of an occupant of a seating device, and activate the lifting assembly to adjust the posture and weight distribution of an occupant; and whereby the motors of the holding assembly generate an axial motion allowing the holding arms to move in multiple directions to compress the holding members against the side of the occupants torso and support the occupant during activation of the lifting assembly.

43. The seating device of claim 42, wherein the up facing surface of the seat board member may be padded with a material selected from a group consisting of foam, leather, or fabric.

44. The seating device of claim 42, wherein the front surface of the back supporting board may be padded with a material selected from a group consisting of foam, leather, or fabric.

45. The seating device of claim 42, wherein the inner surface of each holding member is covered by material that will provide maximum friction and maximum comfort.

46. The seating device of claim 42, wherein the support pads may be made of soft materials such as foam or leather to absorb the pressure caused by the compression of the holding members and provide comfort to the occupant.

47. The seating device of claim 42, wherein the activation of the lifting assembly creates a vertical lifting power.

48. The seating device of claim 47, wherein the vertical lifting power is conducted through the holding assembly causing the holding members to lift up the occupant's upper torso.

49. The seating device of claim 42, wherein the interlocking means of the vertical members engage with the interlocking means of the corresponding rear leg members to lock the lifting assembly into position, and to facilitate the vertical movement of the lifting assembly.

50. The seating device of claim 42, wherein the interlocking means of the vertical members engage with the interlocking means of the chambers of the housing to securably attach the housing to the vertical members.

51. The seating device of claim 42, wherein the control unit further comprises a controller having a control program stored therein, said control unit being operatively connected to the plurality of sensors so as to receive the pressure readings.

52. The seating device of claim 51, wherein the control unit may be connected to the plurality of sensor via a wired or wireless connection.

53. The seating device of claim 51, wherein the control unit is operatively connected to the torque generating means so as to issue signals dictated by the control program to said torque generating means for adjusting the lifting assembly.

54. The seating device of claim 42, wherein the vertical position of the holding members is adjusted by moving the housing of the lifting assembly along with the holding assembly.

* * * * *